US005897672A

United States Patent [19]

Badami et al.

[11] Patent Number: 5,897,672

[45] Date of Patent: Apr. 27, 1999

[54] CLOTHES FABRIC TYPE BLEND DETECTION METHOD AND APPARATUS

[75] Inventors: Vivek Venugopal Badami; Piero Patrone Bonissone, both of Schenectady; Mark Edward Dausch, Latham, all of N.Y.

[73] Assignee: General Electric Company, Schenectady, N.Y.

[21] Appl. No.: 08/985,823

[22] Filed: Dec. 5, 1997

[51] Int. Cl.[6] ..... D06F 33/02

[52] U.S. Cl. ..... 8/159; 68/12.04; 68/12.05; 68/12.21

[58] Field of Search ..... 8/158, 159; 68/12.02, 68/12.04, 12.05, 12.21

[56] References Cited

U.S. PATENT DOCUMENTS

| | | | |
|---|---|---|---|
| 4,400,838 | 8/1983 | Steers et al. | 8/158 |
| 4,481,786 | 11/1984 | Bashark | 62/160 |

(List continued on next page.)

FOREIGN PATENT DOCUMENTS

| | | | |
|---|---|---|---|
| 61-94684 | 5/1986 | Japan | 68/12.05 |
| 2-77296 | 3/1990 | Japan | 68/12.02 |
| 3-32699 | 2/1991 | Japan | 68/12.04 |

OTHER PUBLICATIONS

"Intelligent Dishwasher Outsmarts Dirt", Andrea Baker, Associate Editor, Design News, Apr. 10, 1995, pp. 67–73.

"Decision–Making in a Fuzzy Environment", R. E. Bellman and L.A. Zadeh, Management Science, vol. 17, No. 4, Dec. 1970, pp. B–141–B–165.

"It Washes! It Rinses! It Talks!", Lawrence A. Berardinis, Senior Editor, Machine Design, Sep. 12, 1991, pp. 43–47.

"State–of–the–art in Household Appliances Using Fuzzy Logic", Alanna Quali and Adnan Shaout, University of Michigan, Dept. of Electrical and Computer Engineering—pp. 204–213.

"Sensor Appliance Control, and Fuzy Logic", Michael Lawrence Smith, IEEE Transactions on Industry Applications, vol. 30, No. 2, Mar./Apr. 1994, pp. 305–310.

(List continued on next page.)

*Primary Examiner*—Frankie L. Stinson

*Attorney, Agent, or Firm*—Donald S. Ingraham; Douglas E. Stoner

[57] ABSTRACT

A method and apparatus for detecting the relative proportion of various fabric types present in a clothes load in a clothes washer are provided, in which a set of fuzzy logic membership functions is defined at each clothes load weight across a range of expected load weights to be handled by the clothes washer, with the set of membership functions representing various fabric types that might be present in the clothes load. The membership functions are defined at least in part by a washer operating state that is to be sensed during initial washer operation, and the method includes obtaining a value for the clothes load weight, sensing a value of the washer operating state, and determining a degree of fulfillment of the sensed value in each of the membership functions defined for that given clothes load. The degree of fulfillment represents the relative proportion of the various fabric types for which membership functions are defined, and the information regarding the resultant degrees of fulfillment may be employed in controlling the operation of the washer for optimal performance. The apparatus constitutes a washer controller having a microprocessor that receives signals corresponding to the weight of the clothes load, the sensed value of the predetermined washer operating state, and has stored therein the data necessary to generate the set of membership functions for each clothes load weight.

20 Claims, 18 Drawing Sheets

U.S. PATENT DOCUMENTS

| | | | |
|---|---|---|---|
| 4,607,408 | 8/1986 | Didier et al. | 8/159 |
| 4,835,991 | 6/1989 | Knopp et al. | 68/12 |
| 5,042,276 | 8/1991 | Kamano et al. | 68/12.04 |
| 5,072,473 | 12/1991 | Thuruta et al. | 8/159 |
| 5,144,819 | 9/1992 | Hiyama et al. | 68/12.05 |
| 5,156,025 | 10/1992 | Frucco | 68/12.02 |
| 5,161,393 | 11/1992 | Payne et al. | 68/12.04 |
| 5,208,931 | 5/1993 | Williams | 8/159 |
| 5,230,228 | 7/1993 | Nakano et al. | 68/12.02 |
| 5,233,847 | 8/1993 | Tanaka | 68/12.04 |
| 5,235,827 | 8/1993 | Kiuchi et al. | 68/12.02 |
| 5,241,845 | 9/1993 | Ishibashi et al. | 68/12.02 |
| 5,259,217 | 11/1993 | Civanelli et al. | 68/12.04 |
| 5,284,523 | 2/1994 | Badami et al. | 134/18 |
| 5,291,626 | 3/1994 | Molnar et al. | 8/158 |
| 5,313,964 | 5/1994 | Dausch et al. | 134/57 |
| 5,330,580 | 7/1994 | Whipple, III et al. | 134/18 |
| 5,337,431 | 8/1994 | Kim et al. | 68/12.02 |
| 5,419,163 | 5/1995 | Kim et al. | 68/12.04 |
| 5,515,565 | 5/1996 | Maddix et al. | 68/12.05 |
| 5,577,283 | 11/1996 | Badami et al. | 8/158 |
| 5,600,310 | 2/1997 | Whipple, III et al. | 340/825.06 |
| 5,600,961 | 2/1997 | Whipple, II | 62/175 |
| 5,619,614 | 4/1997 | Payne et al. | 68/12.05 |
| 5,669,095 | 9/1997 | Dausch et al. | 8/158 |
| 5,669,250 | 9/1997 | Dausch et al. | 68/12.02 |
| 5,701,624 | 12/1997 | Shin et al. | 8/159 |
| 5,768,729 | 6/1998 | Cracraft | 68/12.05 |

OTHER PUBLICATIONS

"Introduction to Japanese Consumer Products that Apply Neural networks and Fuzzy Logic", Hideyuki Takagi, University of California at Berkeley, Computer Science Division, pp. 1–8.

"Fuzzy Logic–Based Supervisory Control of Household Appliances", Vivek V. Badami, IEEE, Apr. 1997, pp. 213–217.

"ANFIS: Adaptive–Network–Based Fuzzy Inferencing Systems", IEEE Transactions on Systems, Man and Cybernatics, vol. 23, No. 3, May 1993, pp. 665–685.

CLOTHES FABRIC TYPE BLEND DETECTION METHOD AND APPARATUS

BACKGROUND OF THE INVENTION

1. Field of the Invention

The field of this invention relates to household appliances and, more particularly, to clothes washing machines and to automatic detecting of clothes fabric type in clothes washers.

2. Background

Partial or fully automated control of the operation of clothes washing machines is seen as being desirable from the standpoint of, for example, improving energy efficiency, optimizing usage of water, and providing optimal clothes care. One parameter or factor affecting the ability to automate and optimize the control of the washing machine is the blend of clothes or fabric type (e.g., cotton, polyester), which varies with each washer usage. Detection of the clothes blend in a given washer load would enable an automated washer controller to control various operating states to optimize clothes care and minimize energy usage, for example, by setting the proper amount of water, the proper water temperature, the amount of detergent to be added, and the amount of mechanical washing action to supply to the clothes. Detection of the proportion of each fabric type in a particular clothes load by direct means is not, however, presently seen as being economically feasible for an appliance in the price range of a washing machine, and, therefore, indirect means or methods of sensing the clothes blend making up each load have been proposed.

U.S. Pat. No. 5,241,845, to Ishibashi et al., discloses a washing machine that employs a neural network to determine the appropriate agitation pattern and washing time based on several inputs, including clothes volume and clothes type. Clothes volume and type are inferred from a measurement of the phase angle of the driving motor.

Merloni Elettrodomestica produces a washing machine that estimates the quantity of the clothes load and the fabric type. The load and fabric type are inferred from the rate of change of the water level sensor. Cotton fabric will, for example, absorb water at a much faster rate than will synthetic fibers, such as polyester. Operating conditions in this washing machine, in particular washing time and water temperature, are determined, at least in part, by factors in addition to clothes load and fabric type, for example, by measuring the conductivity of the water to determine its hardness, and including that as a control input. A washing machine produced by AEG of Germany uses a similar approach, in using the rate of change of water level to determine clothes load and type.

U.S. Pat. No. 5,161,393, issued to Payne et al., and assigned to the assignee of the present application, discloses a method for fabric blend sensing that uses the average motor torque of a switched reluctance motor (SRM) during a number of agitation cycles as a measure of clothes load.

This method, as well as others reported in the literature in general, rely on the use of expensive motor control and sensing circuitry in estimating the clothes or fabric blend.

A need continues to exist in the art to automatically detect, by accurate estimation, the blend of fabric types present in loads to be washed, without significantly increasing the overall sensor cost for the washing machine.

SUMMARY OF THE INVENTION

In accordance with the present invention, a method for detecting a blend of clothes fabric types in a clothes load comprises obtaining an estimate of the clothes load (weight) in the washing machine, sensing a value of a predetermined washing machine operating parameter or operating state, and, using the sensed operating parameter and the value of the clothes load, obtaining the estimated proportions of different fabric types using a fuzzy inferencing method relying on previously obtained calibration data.

Various operating parameters or states may be sensed in performing the method of the invention, including the sensing of peak-to-peak amplitude of motor torque during water filling and agitation, the sensing of the amplitude of oscillation in the water level signal during initial agitation, or the sensing of the volume of water required to produce an initial change in the water level signal as the water is introduced into the basket. Washing machines are not commonly equipped with motor torque sensors, however, in the present invention, the motor will generally be a standard inexpensive single phase induction motor, and the load torque in the first example above can be estimated with an inexpensive circuit by measuring the electrical phase angle between the motor voltage and current in real time. The latter two parameters or operating states can be sensed effectively by existing water level sensors, or by water level sensors similar in cost to existing sensors.

BRIEF DESCRIPTION OF THE DRAWINGS

These and other features, aspects, and advantages of the present invention will become better understood when the following detailed description is read with reference to the accompanying drawings, wherein.

DETAILED DESCRIPTION

Figure 1:
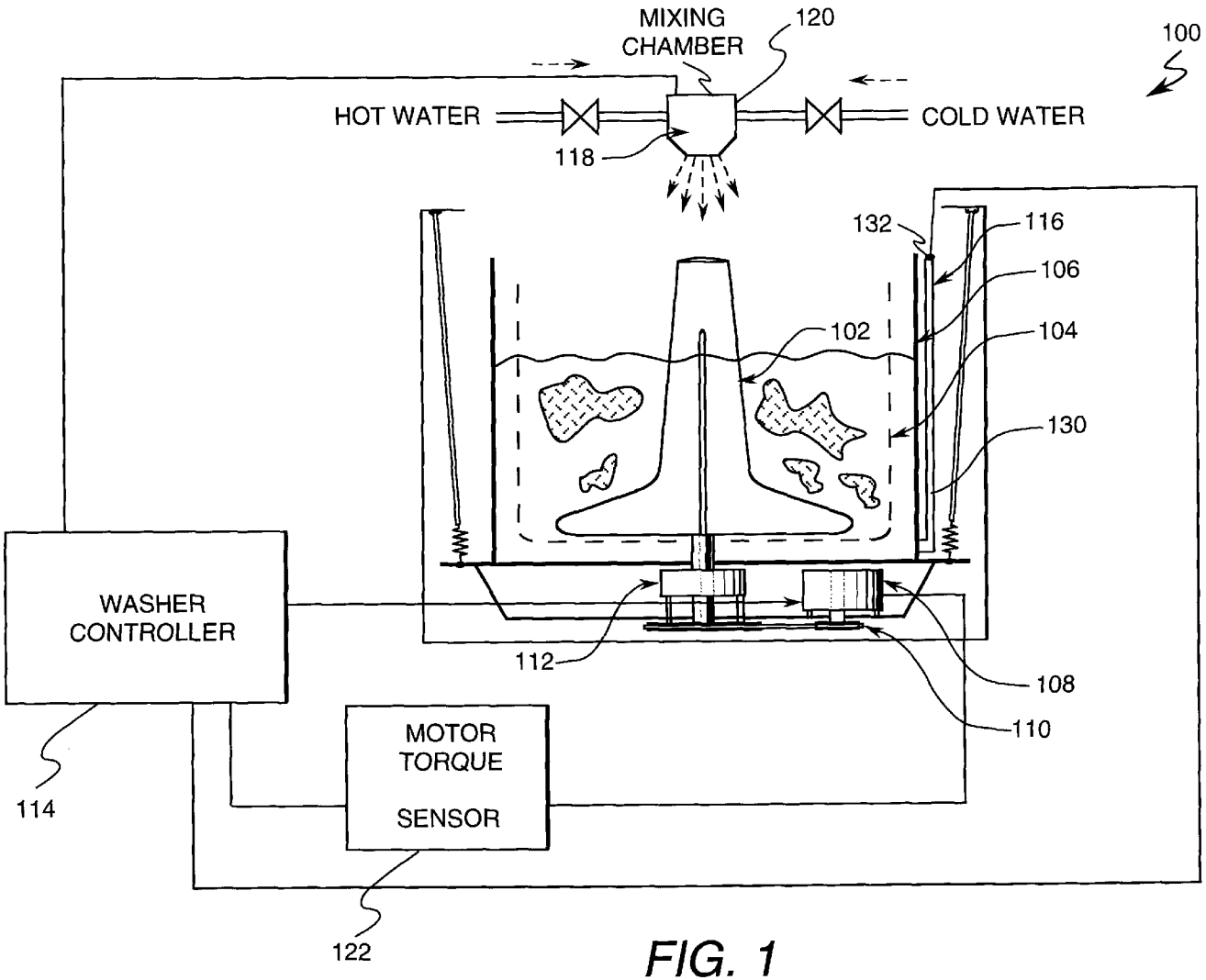
FIG. 1 is a substantially schematic view of a clothes washer suitable for use in the preferred embodiments of the present invention.

FIG. 1 is a substantially schematic view of a representative vertical axis clothes washer 100. The agitator 102 is rotated within basket 104 and tub 106 by a motor 108 coupled to the agitator by a belt-and-pulley arrangement 110 and a transmission 112. The transmission 112 converts the rotary motion of the motor and pulleys into an oscillatory motion of the agitator. In an alternative design, basket 104 may be operatively coupled to the motor 108 via transmission 112 that serves to move the basket in an oscillatory motion.

A washer controller 114 is preferably provided to control the motor speed and/or the amount and temperature of the water delivered to the tub 106. As can be seen in FIG. 1, the typical clothes washer has very few sensors. In most cases, a washer will have only a pressure sensor 116 in fluid communication with tub 106 to detect the water level, and a temperature sensor 118 positioned in or coupled to a water mixing chamber 120 to detect incoming water temperature for control of tube water temperature.

A first embodiment of the invention requires the addition to the typical clothes washer of a motor torque sensor 122. Since the typical motor is a single phase induction motor, the load torque can be estimated very inexpensively, and to a sufficient degree of precision, by measuring the electrical phase angle between the motor voltage and current in real time. A preferred circuit for detecting phase angle in real time for the purpose of serving as a torque sensor is disclosed in U.S. Pat. application Ser. No. 08/496,115, filed Jun. 28, 1995 to Whipple, III et al., which is assigned to the assignee of the present invention. That disclosure is herein expressly incorporated by reference. While the sensing of a phase angle signal is believed to be an advantageous means for accurately estimating the load on the motor, other methods of sensing motor load or torque would suffice for use in the method of the invention.

Second and third embodiments of the invention do not employ a sensing of the motor torque parameter or operating condition, and instead obtain water level values from the water level sensor. In practicing those embodiments, it is not necessary to provide a motor torque sensor.

The three preferred embodiments have in common that the method or detecting the clothes blend involves the use of algorithms that are based on the fact that different fabrics absorb water at different rates, and in different amounts relative to their clothes mass. For example, for a given clothes mass, cottons absorb up to twice their weight in water, which is substantially more than do polyesters.

In each embodiment of the method of the invention, a calibration step is performed to obtain the value of a predetermined parameter or operating state that will later be sensed in actual usage, as a function of clothes load for different fabric types. Fuzzy logic is employed to create a set of load-dependent membership functions for an entire range of loads that the washing machine is equipped to handle. A fuzzy inferencing method is then used during run time to determine, using the weight of the clothes load and the sensed value of the predetermined operating parameter or operating state, the proportion of each of several possible types of fabric present in the specific load.

FIRST EMBODIMENT

In a first preferred embodiment of the invention, the method for detecting the clothes blend involves obtaining a value for the weight of the load of clothes in the washer, determining the load on the motor as water is added and agitation is commenced in the washer, computing an average motor load value at a predefined water level for the clothes load present in the washer, and determining the clothes blend by computing the degree of fulfillment of the average motor load, in a plurality of fabric-type membership functions previously established using fuzzy logic, wherein the degree of fulfillment in each membership function corresponds to the proportion of that fabric type present in the given clothes load.

In the method of the present invention, the value of the weight of the clothes load is obtained by a clothes load estimation procedure, several of which are known in the art, or by user input. The specific manner in which this value is obtained does not constitute a part of the present invention.

For the most part, commercially available clothes washing machines employ induction motors, typically single phase induction motors, as the agitation power source. An especially preferred method for determining the load on such an induction motor is effected by determining the peak-to-peak value of the motor torque during agitation, by sensing or detecting the electrical phase angle between the applied voltage and the field current. This electric phase angle in an induction motor is proportional to the load torque on the motor. The peak-to-peak value of the motor torque is more sensitive to the type of clothes blend than are average motor torque values, and will thus generally provide more accurate estimation of the clothes blend. Peak-to-peak values may also be obtained using inexpensive sensor technology. The circuit to measure phase angle in real-time does not form a specific part of this invention, and a preferred inexpensive circuit is disclosed in the aforementioned Whipple et al. application.

Figure 2:
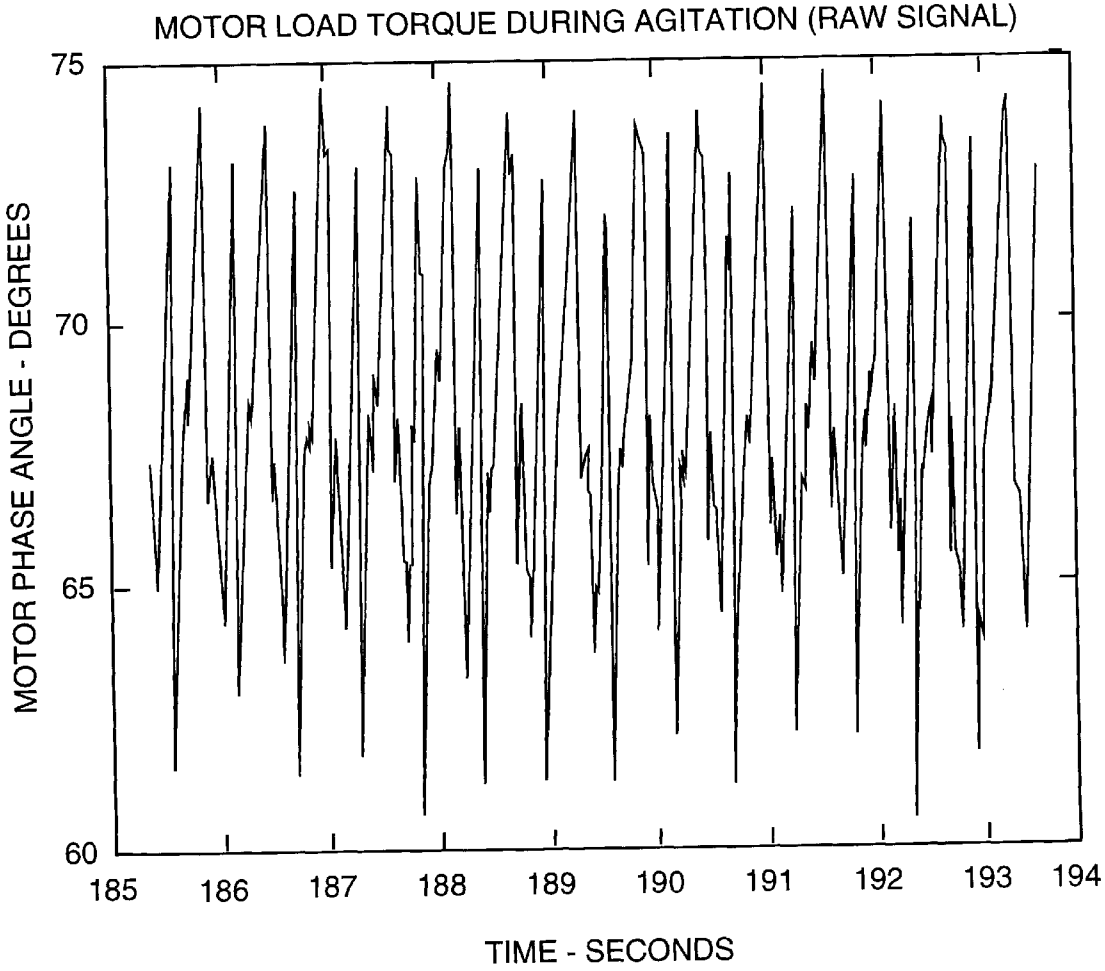
FIG. 2 is a representative graph plotting washer motor phase angle as a function of time during a portion of a washer fill cycle.
Figure 3:
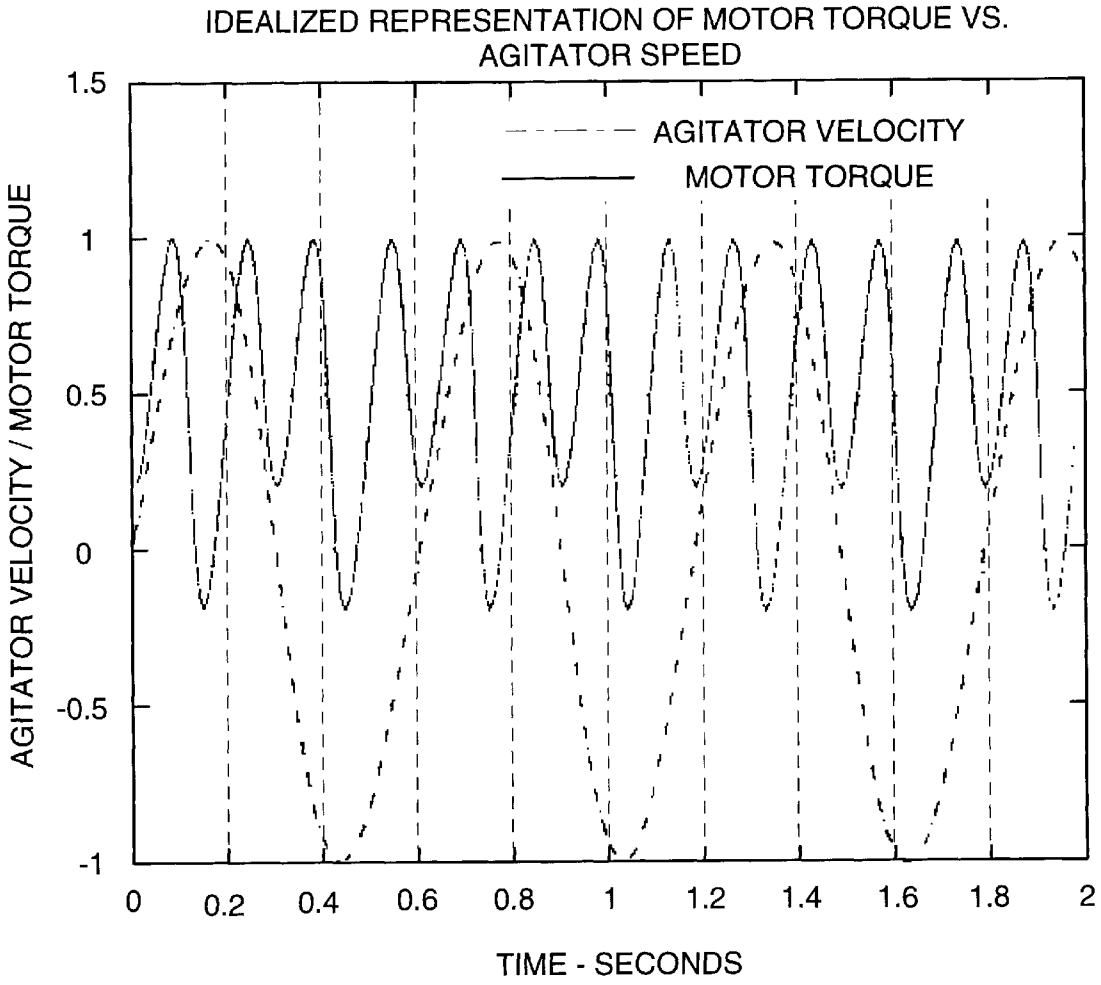
FIG. 3 is a graph illustrating the relationship of motor torque to agitator speed in a clothes washer of the type illustrated in FIG. 1.
Figure 4:
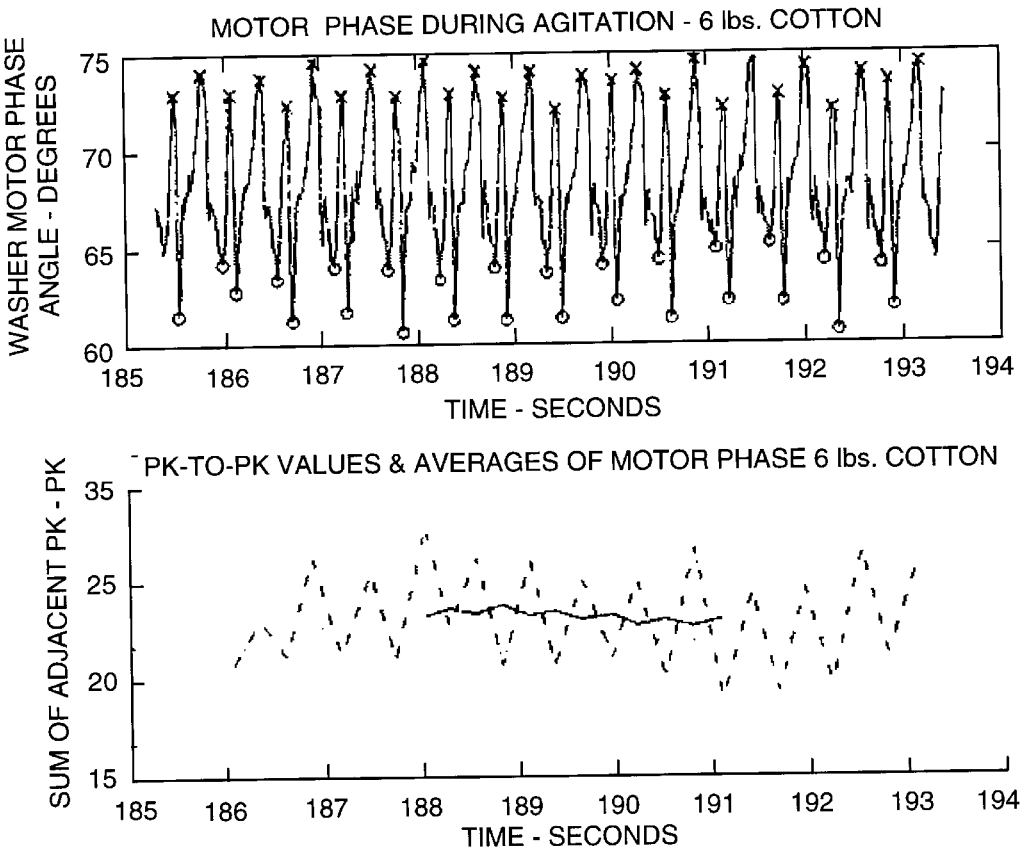
FIG. 4 is a representative graph showing washer motor phase angle as a function of time, and showing the sum of adjacent peak-to-peak motor torque values, and the averaging of those sums.

The relationship between the data acquired from the sensor and the fabric or clothes blend to be determined in the method of the invention is best understood through an understanding of the processing of the raw data to final form. The raw phase angle data from the sensor is to be first processed to determine the peak-to-peak amplitude of variation in the signal. A representative plot of this raw data, showing the motor phase angle during a small portion of the water filling cycle in a washing machine having a six (6) pound cotton fabric load therein, is shown in FIG. 2. As further shown in FIG. 3, the phase angle signal is periodic with half the time period of oscillation of the agitator. The load reflected or transferred from the agitator back to the motor through the transmission 112 and belt-and-pulley 110 goes through a maximum twice in every cycle of the agitator motion. FIG. 4 thus presents, in an upper plot, the data from FIG. 2, with maxima and minima marked by "x's" and "o's", respectively, and, in a lower plot, the amplitude of the torque variation summed for two adjacent peaks, since two phase angle peaks correspond to one complete agitation cycle. Further, the solid line plotted in FIG. 4 illustrates the effect of averaging the amplitude data over a pre-specified window, shown as fifteen (15) peaks, by way of example.

Figure 5:
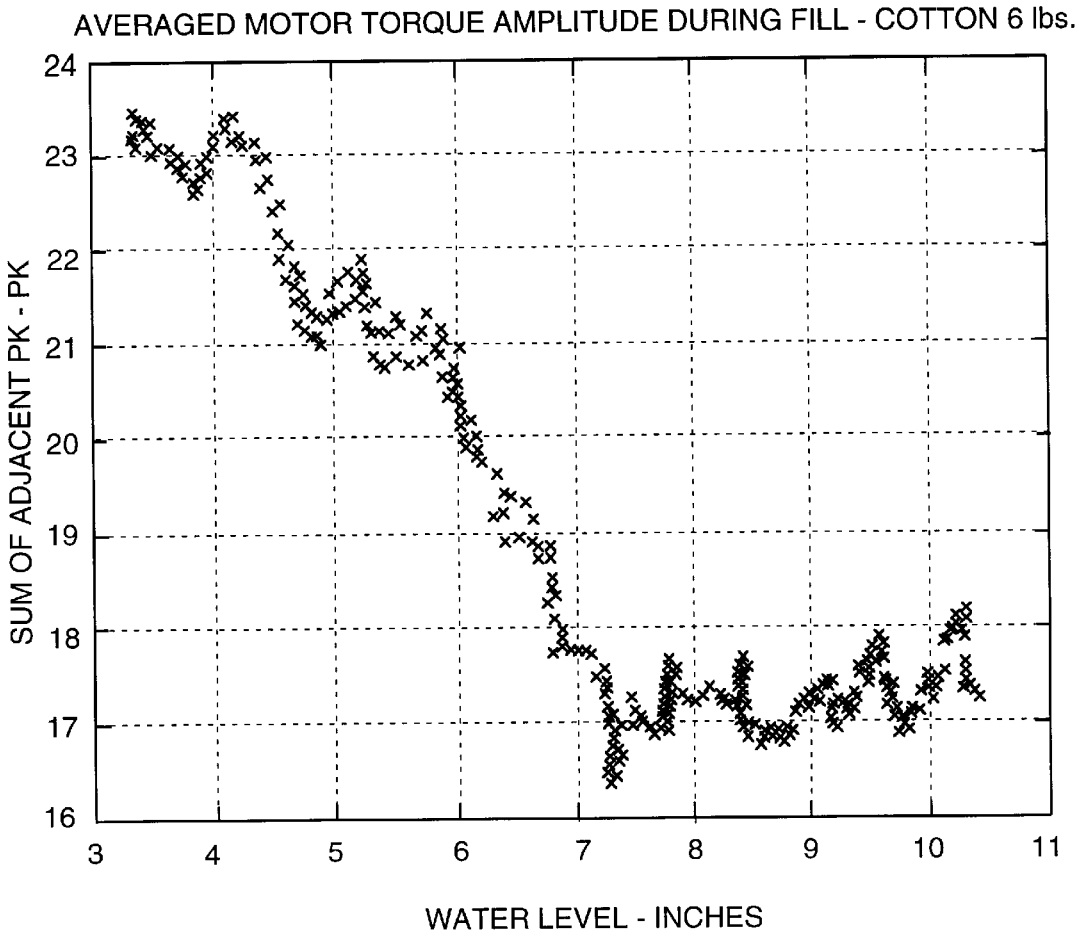
FIG. 5 is a graph plotting an average of peak-to-peak motor phase angles against the water level in the washer tub or basket for a representative clothes load, in accordance with a preferred embodiment of the present invention.

The averaging of the peak-to-peak values of the motor phase angle provides an accurate measure of motor torque amplitude. As seen in FIG. 5, this data is plotted against the corresponding water level in the washer for the complete water filling cycle, to create a motor torque signature for a specific clothes load, here, a six (6) pound cotton load, through the water fill cycle. The reduction in averaged motor torque as the water level increases is explained by the fact that the clothes making up the clothes load become increasingly mobile as water is added, particularly as water is added beyond the point where the fabric is substantially fully saturated with water, and the additional water fills the tub. The increased mobility of the clothes reduces the torque required to agitate the clothes.

Figure 6:
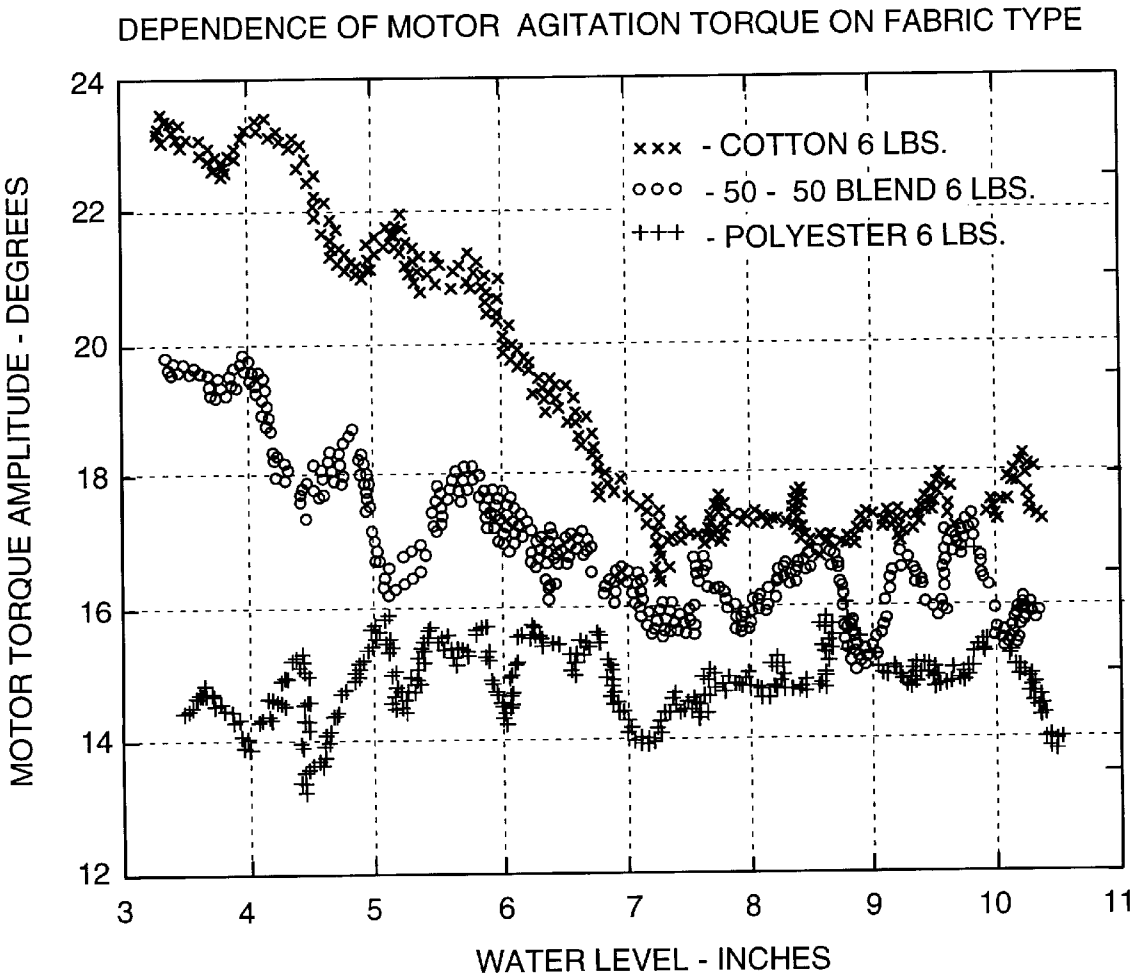
FIG. 6 is a graph plotting average peak-to-peak motor torque amplitudes against the water level in the washer tub or basket, for three different preselected clothes blends, in accordance with a preferred embodiment of the present invention.

The blend detection process in this embodiment of the present invention is based upon the behavior of the load on the motor as the washer is filled with water, as illustrated by way of example in FIG. 5, combined with the fact that different fabrics absorb water at different rates and in different amounts relative to their mass. FIG. 6 is a representative plot of the motor torque amplitude (averaged peak-to-peak phase angle amplitude) plotted against the water level in the tub, for three different washer loads, namely, a six-pound load of cotton fabric, a six-pound load of fabric that is a 50—50 blend of cotton and polyester, and a six-pound load of polyester fabric. These specific loads are used by way of example only, and other clothes blends could be used in this data generating step. The data plot for the cotton load corresponds to the plot of FIG. 5. It can be seen in FIG. 6 that, at low water levels, there is a considerable difference in the motor torque for the three different fabric types, with the cotton fabric requiring the greatest amount of torque for agitation, followed by the 50—50 cotton/polyester blend, and the fully polyester fabric load. This data is consistent with the physical explanation that cotton fabrics absorb more water than other fabric types for a given clothes mass.

The blend detection method can be discussed in terms of a calibration portion or step, and a run-time portion or step. Preparatory to mass production and shipping of the clothes washing machines, a calibration table is generated for the particular washing machine configuration, using a derivation of data as discussed above with respect to FIGS. 2–6, and further working with that data.

It has been determined, in the development of this method, that an optimal water level, representing the water level at which there is a maximum separation between motor torque amplitudes associated with each fabric type, exists for each clothes load weight. In FIG. 6, for example, where the clothes load is six (6) pounds, the optimal water level in the tub is about four (4) inches, where the largest differences between motor torques for the various fabric types are seen.

The calibration table for the particular washing machine configuration is generated by empirically determining, for a number of load sizes that can be handled by the washing machine, the optimal water level (as defined above) for each of the selected load sizes. In other words, data analogous to that presented in FIG. 6 is obtained for a number (preferably a small number) of load weights, for example, loads of two (2) pounds, six (6) pounds, ten (10) pounds, and fourteen (14) pounds. The data may be plotted for each load size to determine the optimal water level, or may otherwise be processed to determine the water level at which the maximum spread in motor torque exists, for each load size.

As an example of the calibration step in the first preferred embodiment, several runs were made with different loads of clothes for each of the same three fabric types as were used in the runs for which results are presented in FIG. 6. The runs were conducted with the two-pound, six-pound (FIG. 6), ten-pound, and fourteen-pound loads, as a representative range of possible washer loads. An optimal water level for each load size was computed in processing the motor torque amplitude data, and FIG. 7 presents a plot of the average motor torque versus the load size, at the optimal water level for that load size, for each of the three different fabric types tested.

Figure 7:
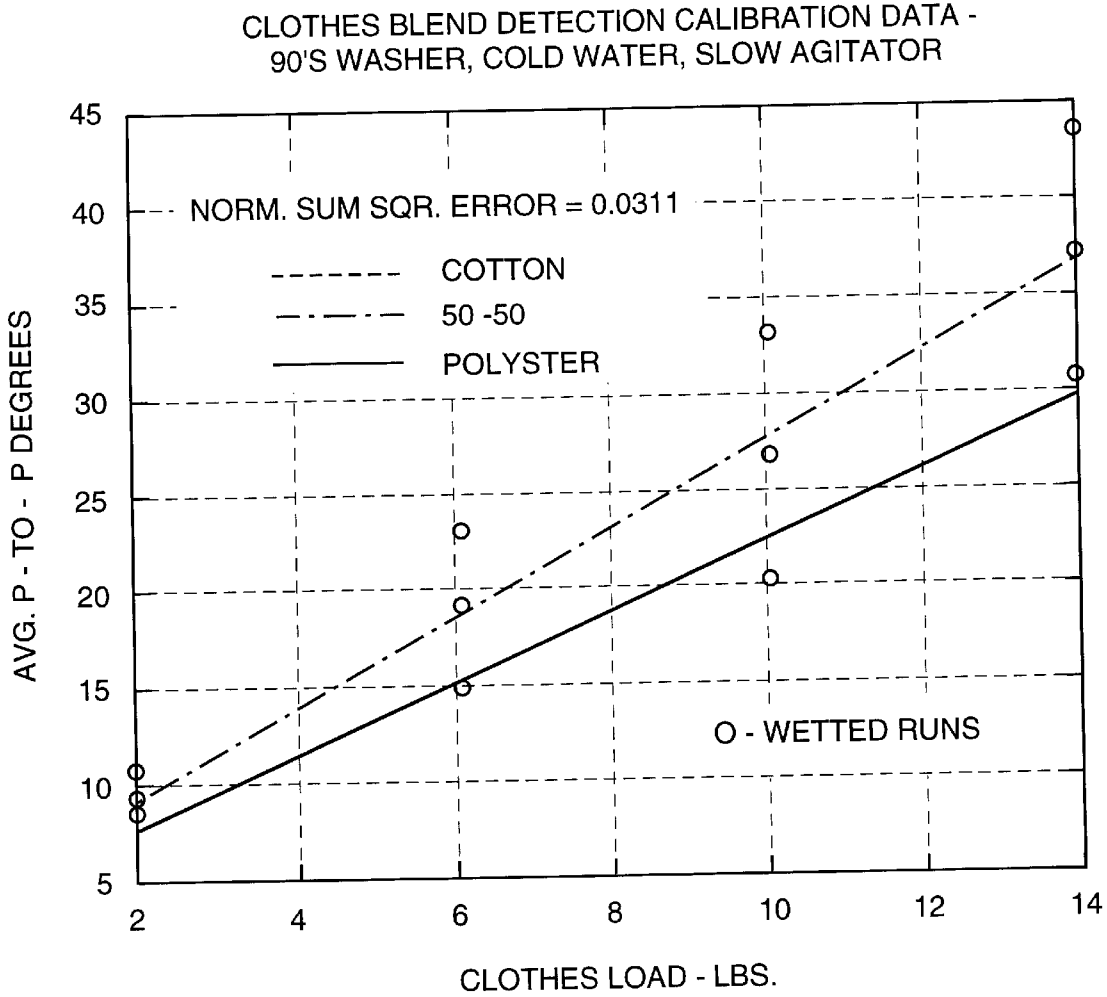
FIG. 7 is a graph plotting average motor torque amplitude as a function of the weight of the clothes load for the three types of clothes blends employed in developing the graph of FIG. 6.

While FIG. 7 and the ensuing discussion involve non-normalized data, for purposes of clarity it should be kept in mind that the motor torque data may preferably be normalized to the peak-to-peak amplitude of motor torque as obtained using an empty basket (i.e., no clothes load). Normalization of the data in this manner will minimize the error in the overall blend estimation method that can result from the slightly different performance of each individual washer unit produced, the potentially different performance being occasioned by the fact that certain manufacturing tolerances are permitted, which may include varying motor torques, belt tensions, and agitator stiffness. Periodic normalization, once the washer is in use, can also aid in reducing any error in the blend detection method caused by the effects of mechanical aging of the components. Such normalization steps will be readily apparent to those of ordinary skill in the art upon reading this disclosure, and further details of such steps need not be provided herein.

A least squares straight line was fitted to the actual data points in FIG. 7 (four points for each fabric type), and it can be seen, as a result, that a substantially linear relationship exists between motor torque and load size for each fabric type. The lines also evidence, by the increasing slope when progressing from the polyester line to the cotton line, that the additional torque required with increasing clothes load increases at a greater rate with cottons, followed by 50—50 blends and polyesters.

Individual items of clothing may have a different fabric make up or blend than the three fabric types selected for illustrative purposes herein, however, pure cotton and pure polyester fabrics can generally be assumed to require the greatest and the least motor torque, respectively, for a given clothes load weight. Indeed cottons and polyesters and blends thereof make up the vast majority of fabric types that would be washed in a washing machine.

Since real world clothes loads can comprise an arbitrary mix of fabric types, the actual motor torques that will be sensed in "run-time" will lie between the calibration lines plotted in FIG. 7 for cotton and polyester. A fuzzy logic approach for interpolating between the calibration lines has been determined, in accordance with the invention, to be a desirable way of accurately completing the clothes blend detection process. In general, fuzzy logic is a decision-making process used when the choices between alternatives or set membership is not sharply defined. Despite the fact that there is no sharp transition from membership to non-membership in fuzzy sets, such sets do convey information despite their imprecision.

A non-standard approach must be used for defining the membership functions to be applied to the fuzzy logic interpolation process, due to the overlap in motor torque values for the fabric types as the load increases, and due to the fact that the fabric type calibration lines diverge (see FIG. 7) with increasing load size. The defined membership functions must therefore be made dependent on load size.

Figure 8:
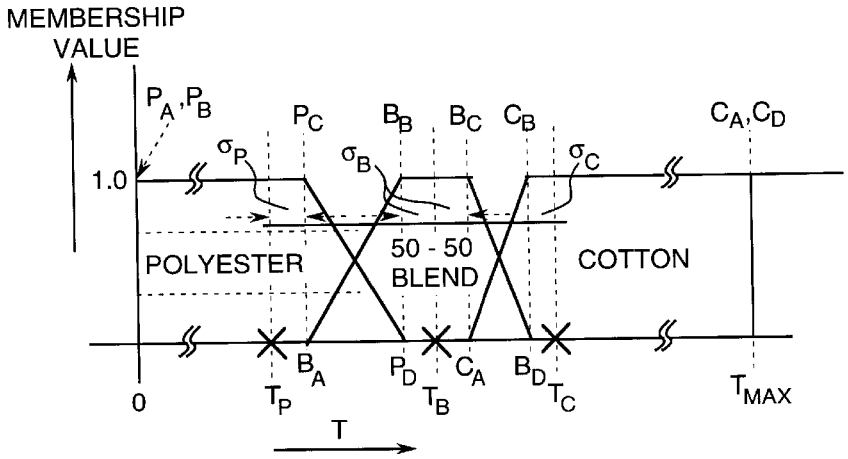
FIG. 8 is a representative illustration of the plot of membership functions, at a given load or weight, for the three types of clothes blends employed in generating the data presented in FIGS. 6 and 7.

FIG. 8 illustrates a representative or schematic mapping of the membership functions of the three fabric types for which the calibration table of FIG. 7 was prepared, at a given load size, and as a function of operating state or parameter T, which, in this embodiment, is the value of the motor torque amplitude. It is assumed, in defining the membership functions in this manner, that all clothes fabrics will be one of the three fabric types. Other finer or coarser partitionings of the universe of blends may be made, however, it is believed that the three partitionings will suffice for the purpose of controlling the operation of a clothes washer.

The membership functions illustrated in FIG. 8 are defined as trapezoids whose inflection points are determined by ordinates of the calibration lines (straight line fits) in the calibration table of FIG. 7. The parameters of the membership functions, for any given load size, are as follows:

$$C_A=T_B+\sigma_B$$

$$C_B=T_C-\sigma_C$$

$$C_C=T_{max}$$

$$C_D=C_C$$

$$B_A=T_P+\sigma_P$$

$$B_B=T_B-\sigma_B$$

$$B_C=T_B+\sigma_B$$

$$B_D=T_C-\sigma_C$$

$$P_A=0$$

$$P_B=0$$

$$P_C=T_P+\sigma_P$$

$$P_D=T_B-\sigma_B$$

where, $T_P, T_B, T_C$=motor torque amplitudes from least squares line fit for given load;

$T_{max}$=maximum possible torque amplitude;

$\sigma_P$, $\sigma_B$, $\sigma_C$=spread (max-min), nominally the standard deviation or a fraction thereof, in torque values within a set of runs for a given load and fabric type.

In this embodiment, wherein motor torque values are to be sensed or calculated in determining the clothes blend, it is preferred that the $\sigma_P$, $\sigma_B$ and $\sigma_C$ values used in defining the parameters of the membership functions, be selected as one-half of the computed standard deviation or spread in motor torque values, as it is believed that this will result in the most accurate clothes blend determinations in the run-time portion of the method. The fraction of the spread value used in the membership function definition can be varied to tune the performance or accuracy of the clothes blend determination method. The membership functions can further be automatically tuned using input-output data with known algorithms such as ANFIS (Adaptive Neuro-Fuzzy Inference System).

Figure 9:
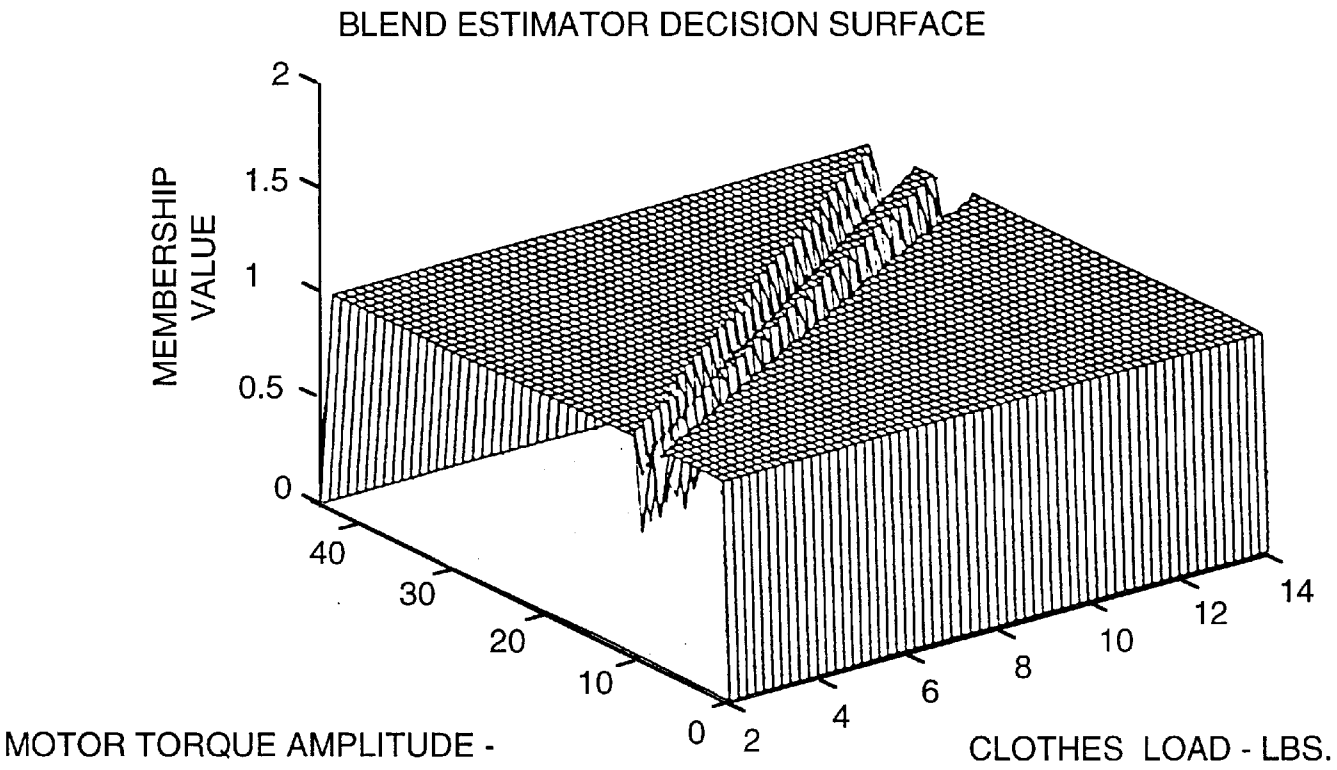
FIG. 9 is a three-dimensional representation of the set of membership functions for the three fabric types across a range of clothes loads in accordance with a preferred embodiment of the present invention.

FIG. 9 illustrates a three-dimensional plot of all of the membership functions generated for the entire range of anticipated load sizes, from two (2) pounds to fourteen (14) pounds, a typical capacity of a clothes washing machine for home use. The three-dimensional plot can be referred to as a decision surface, and the decision surface may be generated and stored as a look-up table in a read-only memory (ROM) of the washer controller 114. Alternatively, a set of load dependent membership functions can be calculated at run-time, provided the calibration line fit data and the definitions of the membership function parameters are stored for use by the controller 114.

In the run-time step or portion of the clothes blend detection method, a user places items of clothing or other fabric to be washed into the washer, and the collective group of items will thus be an arbitrary or unknown mix of fabric types. An estimation of the clothes load weight is either selected by the user, or is determined in the very initial stage of the wash cycle, by a known means. The wash cycle is started, with the water being introduced into the washer tub 106 while the agitator is running. The average peak-to-peak motor torque is computed continuously by the controller 114 during this phase, and, upon reaching the predetermined (and stored) optimal water level for the previously established weight of the clothes load, the average peak-to-peak motor torque value is stored in controller 114. The controller then calculates the membership functions using the calibration data and the parameter constraints as discussed above, or by accessing a previously stored look-up table containing the data representing the decision surface of FIG. 9.

Figure 10:
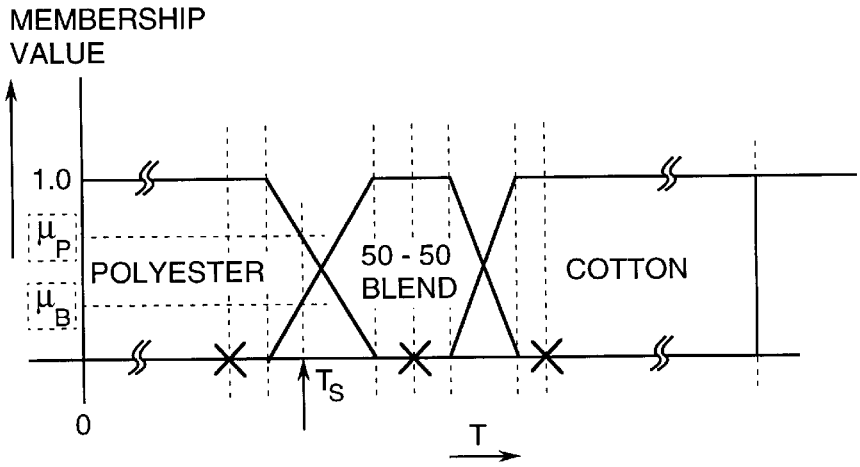
FIG. 10 is an illustration of the plot of membership functions shown in FIG. 8, and presenting an example of the degree of fulfillment in each membership function by a particular sensed average motor torque, in accordance with a preferred embodiment of the present invention.

Once the membership functions have been ascertained, the clothes blend is then calculated by computing the degree of fulfillment of the average peak-to-peak torque, which was earlier computed and stored, in each of the membership functions for cotton, 50—50 cotton/polyester blend, and polyester. This computation or inferencing process yields a triplet of numbers, $\mu_C$, $\mu_B$, $\mu_P$, corresponding to the proportions of cotton, 50—50 blend, and polyester, respectively, in the clothes load being washed. A graphical representation of the inferencing process can be seen in FIG. 10, wherein $T_S$ is the point along the axis labeled T representing the sensed and stored average peak-to-peak motor torque, as applied to the set of membership functions calculated or retrieved for the specific clothes load. As can be seen in that Figure, the membership value or degree of fulfillment for polyester fabric, $\mu_P$, is approximately 0.67, and the membership value for the 50—50 blend fabric is approximately 0.33. The membership value for cotton fabric is 0, indicating that the detection method inferred that there was no pure cotton fabric in the clothes load, based on the low value of the sensed motor torque.

The washer controller 114 may preferably use the information obtained from this clothes blend detection method to set or control various washer operating states or parameters that will be best suited to cleaning the particular clothes blend detected. The specific approach to optimizing washing machine performance does not form part of the present invention, but may be based upon performance criteria such as minimizing water and energy consumption, minimizing clothes wear, minimizing detergent usage, minimizing noise, minimizing cycle time, and maximizing cleaning.

In a demonstration of the accuracy of the blend detection method in this embodiment, it was determined that the mean squared error (MSE), using the method for a grouping of twenty-three (23) test cases, was computed to be 0.192. As the maximum possible MSE is 2.0, the above detection method has an error rate of 9.6%, as a percentage of the largest possible error. In this demonstration, the MSE was computed as follows:

$$MSE=\Sigma[(\mu_{Tc}-\mu_{Ac})^2+(\mu_{TB}-\mu_{AB})^2+(\mu_{TP}-\mu_{AP})^2]\div N$$

where, $\mu_{TC}$, $\mu_{TB}$, $\mu_{TP}$—are the target degrees of membership in the cotton, blend, and polyester fuzzy sets for the given test load, and, $\mu_{AC}$, $\mu_{AB}$, $\mu_{AP}$—are the actual degrees of membership as estimated by the blend detection algorithm, and, N—is the number of test runs.

This demonstration establishes that the method is sufficiently accurate for determining a clothes blend for the purposes of controlling washer operating states or parameters in washing clothes.

SECOND EMBODIMENT

In a second preferred embodiment of the invention, the method for detecting the clothes blend involves obtaining a value for the weight of the load of clothes in the washer, sensing a water level to determine a water level inflection point as water is added and agitation is commenced in the washer, and determining the clothes blend by computing the degree of fulfillment of the water level inflection point, in a plurality of fabric-type membership functions previously established using fuzzy logic, wherein the degree of fulfillment in each membership function corresponds to the proportion of that fabric type present in the given clothes load.

As with the first preferred embodiment, the value of the weight of the clothes load is obtained by a clothes load estimation procedure, several of which are known in the art, or by user input. The specific manner in which this value is obtained does not constitute a part of the present invention.

In this second preferred embodiment of the clothes blend detection method, a set of load-dependent membership functions is generated based on a sensed water level inflection point. As used herein, the term "water level inflection point" is defined as the water volume in washer tub 106 at which the water level sensor 116 first begins signaling an increase in the water level in the tub 106.

The water level sensor 116 schematically illustrated in FIG. 1 is of the type in which a pressure tube 130 is attached at one end to the bottom region of tub 106, in fluid communication therewith. The other end of pressure tube 130 has a pressure sensitive transducer 132 serving as a pressure sensor. As water is introduced into tub 106 during a water fill cycle, water enters and rises in pressure tube 130, compressing the air column within tube 130, resulting in a pressure rise in the tube. Transducer 132 converts the sensed pressure to an electrical signal, which signal is sent to washer controller 114 or to another microprocessor, for use in controlling the operation of the washer.

Figure 11:
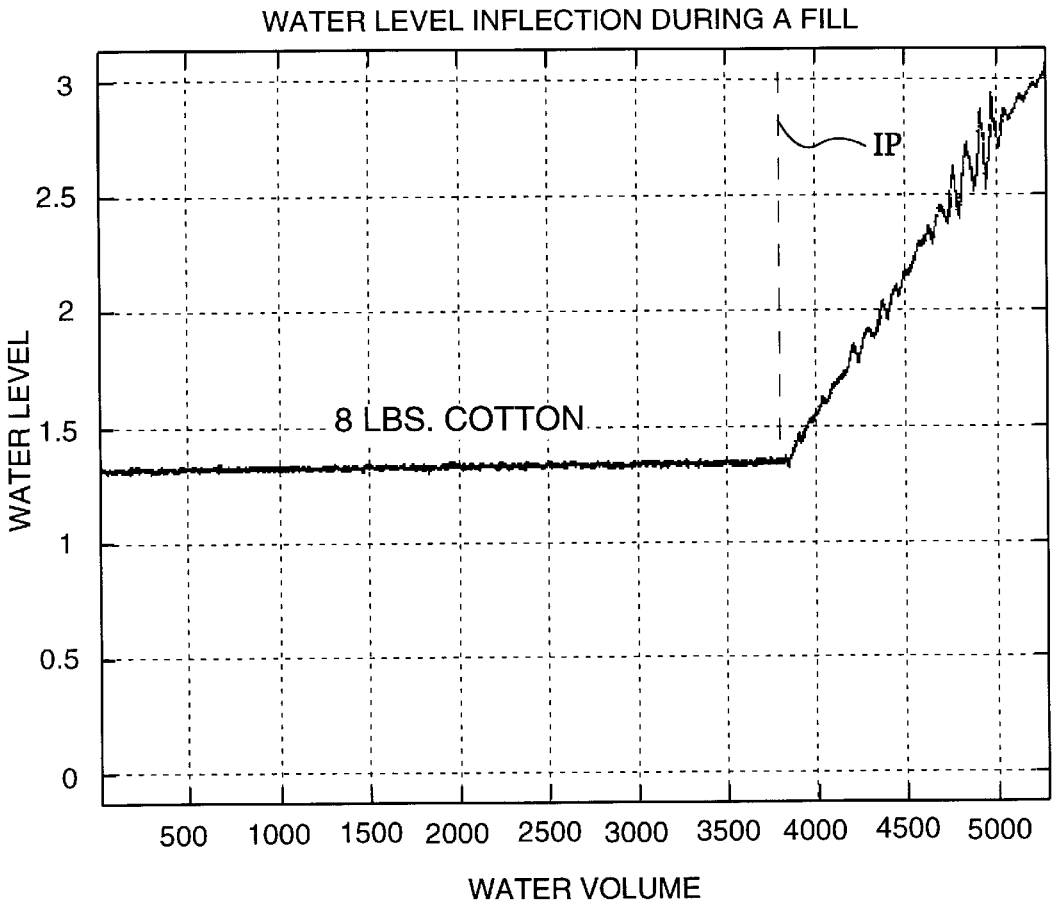
FIG. 11 is a graph plotting a sensed water level in a washer tub as a function of units of water volume, in accordance with another preferred embodiment of the present invention.

A beneficial characteristic of this type of water level sensor employed in clothes washers is that an increase in water level is not sensed immediately upon commencement of the water fill cycle. In other words, a minimum volume of water in the tub 106 is required in order to produce a measurable change in the pressure in tube 130. Once this minimum volume of water has been filled in the tub, there is a sudden change in the water level signal generated by the sensor. This volume represents the point referred to herein as the water level inflection point. FIG. 11 illustrates a representative plot of the water level signal as a function of actual water volume in the washer tub, for an eight-pound load of cotton fabric. The water level inflection point in this plot is identified by a vertical dashed line IP.

It is to be noted that, while a sensor having this type of behavior is ideally suited for the clothes blend determination method, the method may also be effectively used in conjunction with water level sensors in which the sensed water level change is more gradual.

As with the first embodiment of the clothes blend detection method discussed above, an important aspect of this second embodiment is that the method relies on the fact that different fabrics absorb water at different rates and in different amounts relative to their mass. As water is added to the tub, water is, in large part, initially absorbed by the fabric mass therein until the fabric nears or reaches a saturation point.

Because the water level sensor in the washer operates by sensing the level of the standing water in the tub, the water absorbed by the fabric is not directly sensed by the sensor. As a result, the water level inflection point will be reached at a lower total water volume when the fabric in the washer absorbs relatively little water, as does polyester. A load of cotton fabric which absorbs a relatively greater amount of water, and absorbs it relatively more quickly, will produce a water level inflection point at a higher total water volume. Stated more generally, the water level inflection point is dependent on the clothes blend or fabric type for a given clothes mass.

Figure 12:
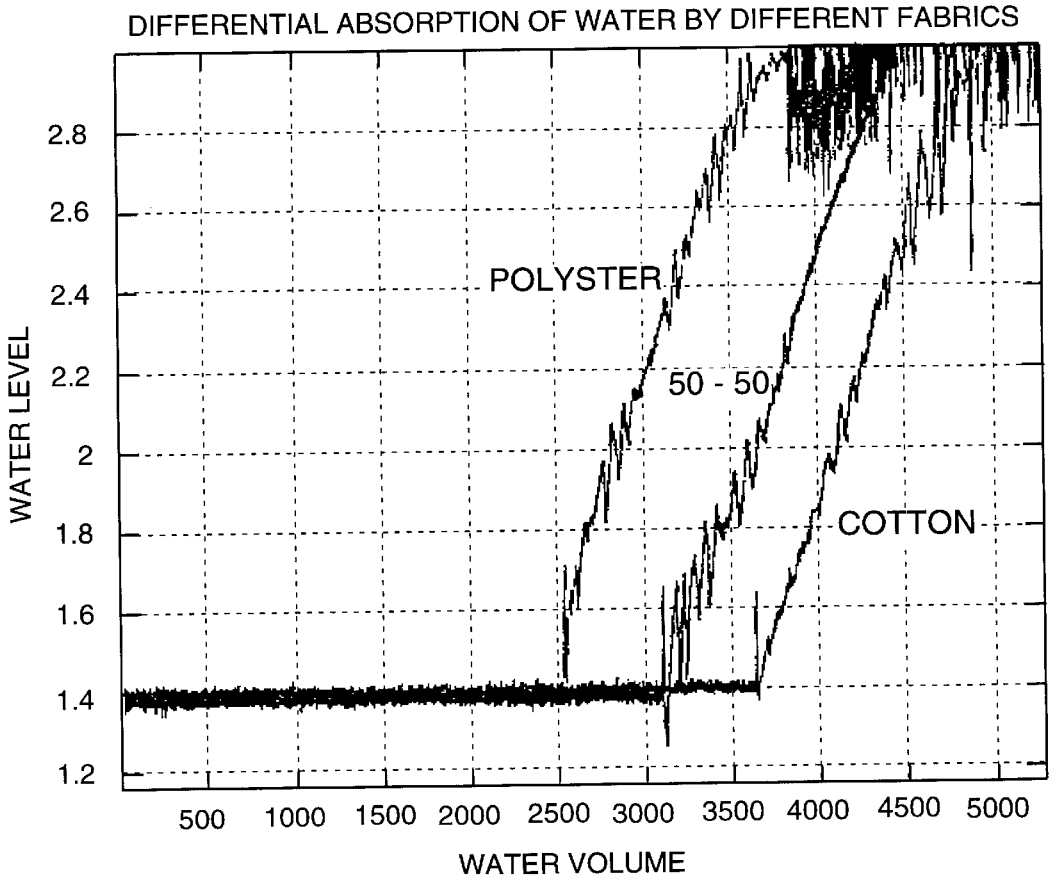
FIG. 12 is a graph plotting the sensed water level in a washer tub as a function of units of water volume, for three different fabric blend types.

FIG. 12 is a plot of water level sensor output as a function of total water volume added to a washer tub 106, showing the sensed water level change for eight-pound (dry) loads of 100% polyester, 50—50 mixture of cotton and polyester, and 100% cotton. Consistent with the fact that cotton fabric absorbs more water per unit of mass than do other fabric types, the water level inflection point for cotton is at the highest total water volume, followed by the 50—50 blend, and then by the polyester fabric. Using this basic principle of the different absorption of water by different fabric types, the clothes blend detection method may preferably use a fuzzy inferencing methodology for accurately determining the clothes blend in unknown or arbitrary clothes loads in washing machines.

The blend detection method in the second preferred embodiment can also be discussed in terms of a calibration portion or step, and a run-time portion or step. Preparatory to mass production and shipping of the clothes washing machines, a calibration table is generated for the particular washing machine configuration, using a set of data generated along the lines discussed above with respect to FIGS. 11 and 12.

The calibration table for the particular washing machine configuration is generated by empirically determining, for a number of load sizes that can be handled by the washing machine, the water level inflection point for a series of defined fabric types at various clothes loads. In other words, data analogous to that presented in FIG. 12 is obtained for a number (preferably a small number) of load weights, for example, loads of two (2) pounds, six (6) pounds, ten (10) pounds, and fourteen (14) pounds. The water level inflection points obtained from that data may be plotted against load size, or otherwise stored for later use.

As an example of the calibration step in the second preferred embodiment, several runs were made with different loads of clothes for each of the same three fabric types as were used in the runs for which results are presented in FIG. 12. The runs were conducted with two-pound, six-pound, ten-pound, and fourteen-pound loads, as a representative range of possible washer loads. At least three calibration runs were made for each fabric type at each clothes load. An average water level inflection point for each fabric type at each load size was determined, and FIG. 13 presents a plot of the water level inflection point, as measured by the total water volume added to the washer tub, versus the load size for each of the three different fabric types tested.

Figure 13:
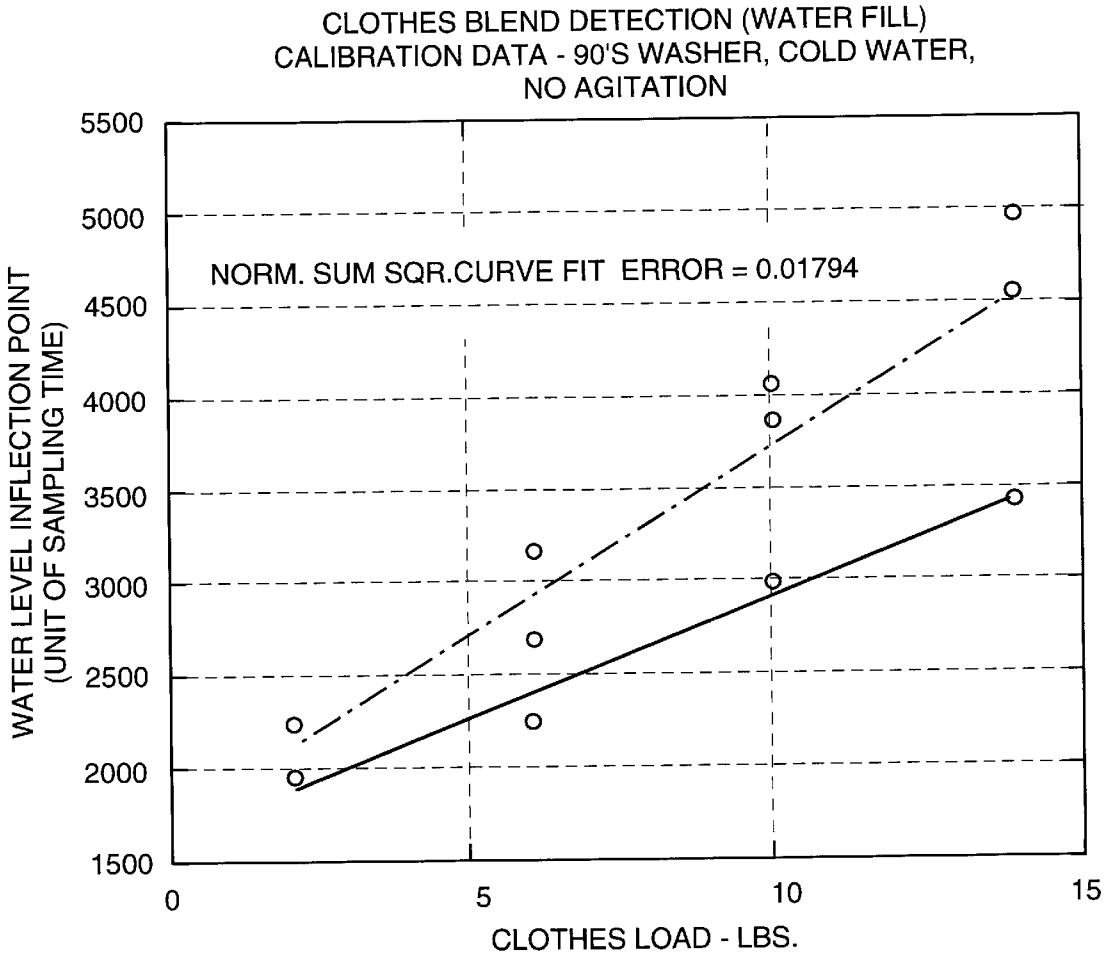
FIG. 13 is a graph plotting the water level inflection point as a function of the weight of a clothes load, for the three different fabric types employed in generating the data in FIG. 12.

While FIG. 13 and the ensuing discussion involve non-normalized data, for purposes of clarity it should be kept in mind that the water level inflection point data may preferably be normalized to that of an empty basket (i.e., no clothes load). Normalization of the data in this manner will minimize the error in the overall blend estimation method that can result from the slightly different performance of each individual washer unit produced, due to the use of manufacturing tolerances permitting minor variation in water level sensor accuracy and pressure tube length. Periodic normalization, once the washer is in use, can also aid in reducing any error in the blend detection method caused by the effects of mechanical aging of the components.

A least squares straight line was fitted to the actual data points, which represent an average of the water level inflection points from the at least three runs done for each fabric type at each clothes load value, in FIG. 13 (four points for each fabric type). It can be seen, as a result, that a substantially linear relationship exists between water level inflection point and load size for each fabric type. The lines also evidence, by the increasing slope when progressing from the polyester line to the cotton line, that the rate of increase in the inflection point value with increasing clothes load is greater for cottons, than for 50—50 blends and polyesters, respectively.

Individual items of clothing may have a different fabric make up or blend than the three fabric types selected for illustrative purposes herein, however, pure cotton and pure polyester fabrics can generally be assumed to produce the highest and lowest value for the water level inflection, respectively, for a given clothes load weight. Indeed cottons and polyesters and blends thereof make up the vast majority of fabric types that would be washed in a washing machine.

The actual water level inflection points that will be sensed at "runtime" will lie between the calibration lines plotted in FIG. 13 for cotton and polyester. As with the method in the first preferred embodiment, a fuzzy logic approach for interpolating between the calibration lines has been determined to be a desirable way of accurately completing the clothes blend detection process.

As also was the case with the first preferred embodiment, a non-standard approach must be used for defining the membership functions to be applied to the fuzzy logic interpolation process, due to the overlap in water level inflection point values for the fabric types as the load increases, and due to the fact that the fabric type calibration lines diverge (see FIG. 13) with increasing load size. The defined membership functions must therefore be made dependent on load size.

Referring back to FIG. 8, a representative or schematic mapping of the membership functions of the three fabric types for which the calibration table of FIG. 13 was prepared, is shown for a given load size. The only difference between the mapping of the membership functions in this second embodiment and in the first preferred embodiment is that, for the axis labeled T, the T represents the water level inflection point in this embodiment whereas, in the first embodiment, T represented motor torque. The same assumptions regarding the adequacy of using the three fabric types applies, and the possibility of using a finer or a coarser partitioning, applies to this embodiment as well.

The membership functions illustrated in FIG. 8 are defined as trapezoids whose inflection points are determined by ordinates of the calibration lines (straight line fits) in the calibration table of FIG. 13. The parameters of the membership functions, for any given load size, are the same as the parameters set forth in the disclosure of the first preferred embodiment, with the exception that the variables denominated by T ($T_P$, $T_B$, $T_C$, $T_{max}$) represent water level inflection point values instead of average motor torque values. Correspondingly, the values of $\sigma_P$, $\sigma_B$, $\sigma_C$ are defined as a spread (max—min), nominally the standard deviation or a fraction thereof, in water level inflection values within a set of runs for a given load and fabric type.

In this embodiment, wherein water level inflection values are to be sensed or calculated in determining the clothes blend, it is preferred that the $\sigma_P$, $\sigma_B$ and $\sigma_C$ values used in defining the parameters of the membership functions be equal to the standard deviation or spread in water level inflection values, as it is believed that this will result in the most accurate clothes blend determinations in the run-time portion of the method. The fraction of the spread value used in the membership function definition can be varied to tune the performance or accuracy of the clothes blend determination method. The membership functions can further be automatically tuned using input-output data with known algorithms such as ANFIS (Adaptive Neuro-Fuzzy Inference System).

Figure 14:
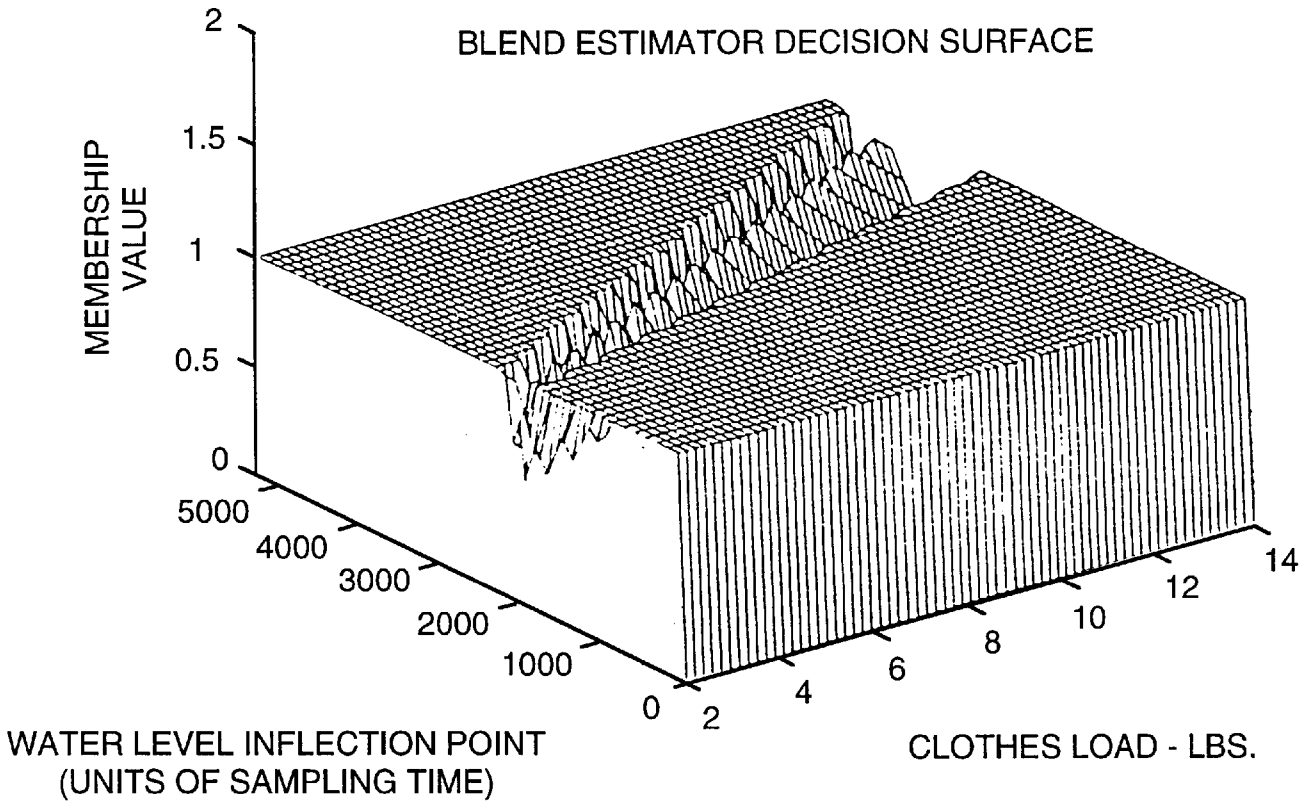
FIG. 14 is a three-dimensional representation of the set of membership functions for the three fabric types across a range of clothes loads, and as a function of the water level inflection point, in accordance with this alternative preferred embodiment.

FIG. 14 illustrates a three-dimensional plot of all of the membership functions generated for the entire range of anticipated load sizes, from two (2) pounds to fourteen (14) pounds, a typical capacity of a clothes washing machine for home use. The three-dimensional plot can be referred to as a decision surface, and the decision surface may be generated and stored as a look-up table in a read-only memory (ROM) of the washer controller 114. Alternatively, a set of load dependent membership functions can be calculated at run-time, provided the calibration line fit data and the definitions of the membership function parameters are stored for use by the controller 114.

In the run-time portion of this second preferred embodiment of the clothes blend detection method, a user places items of clothing or other fabric to be washed into the washer, and the collective group of items will thus be an arbitrary or unknown mix of fabric types. An estimation of the clothes load weight is either selected by the user, or is determined in the very initial stage of the wash cycle, by a known means. The wash cycle is started, with the water being introduced into the washer tub 106. The output signal of the water level detector is monitored by controller 114, and the derivative of the water level value is continuously calculated by the microprocessor in the controller, to detect the water level inflection point. This point is detected by determining when the derivative exceeds a predetermined threshold that is determined empirically. The controller stores the data point in memory, and then calculates the membership functions using the calibration data and the parameter constraints as discussed above, or by accessing a previously stored look-up table containing the data representing the decision surface of FIG. 14.

Figure 15:
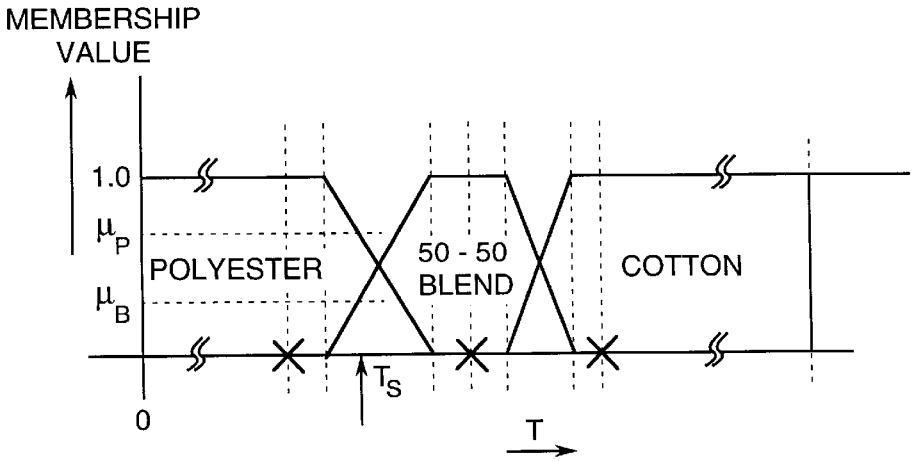
FIG. 15 is an illustration of a plot of membership functions at a given clothes load, showing the degree of fulfillment in each membership function by a particular sensed water level inflection point.

Once the membership functions have been ascertained, the clothes blend is then calculated by computing the degree of fulfillment of the detected water level inflection point in each of the membership functions for cotton, 50—50 cotton/polyester blend, and polyester. This computation or inferencing process yields a triplet of numbers, $\mu_C$, $\mu_B$, $\mu_P$, corresponding to the proportions of cotton, 50—50 blend, and polyester, respectively, in the clothes load being washed. A graphical representation of the inferencing process can be seen in FIG. 15, wherein $T_S$ is the point along the axis labeled T representing the sensed and stored water level inflection point, as applied to the set of membership functions calculated or retrieved for the specific clothes load. As can be seen in the example in that Figure, the membership value or degree of fulfillment for polyester fabric, $\mu_P$, is approximately 0.67, and the membership value for the 50—50 blend fabric is approximately 0.33. The membership value for cotton fabric is 0 in this example, indicating that the detection method inferenced that there was no pure cotton fabric in the clothes load, based on the low value of the sensed water level inflection point.

The washer controller 114 may preferably use the information obtained from this clothes blend detection method to set or control various washer operating states or parameters that will be best suited to cleaning the particular clothes blend detected, as described previously with respect to the first preferred embodiment.

In a demonstration of the accuracy of the blend detection method in this embodiment, it was determined that the mean squared error (MSE), as defined previously, using the method for a grouping of sixty-seven (67) test cases, was computed to be 0.404. As the maximum possible MSE is 2.0, the above detection method has an error rate of 20.2%, as a percentage of the largest possible error. This demonstration establishes that the method is sufficiently accurate for determining a clothes blend for the purposes of controlling washer operating states or parameters in washing clothes.

THIRD EMBODIMENT

In a third preferred embodiment of the invention, the method for detecting the clothes blend involves obtaining a value for the weight of the load of clothes in the washer, sensing an amplitude of oscillation of a water level signal during an agitation cycle as agitation is commenced in the washer, averaging the amplitudes sensed, up to a predefined water level, and determining the clothes blend by computing the degree of fulfillment of the average water level signal amplitude, in a plurality of fabric-type membership functions previously established using fuzzy logic, wherein the degree of fulfillment in each membership function corresponds to the proportion of that fabric type present in the given clothes load.

As with the first and second preferred embodiments, the value of the weight of the clothes load is obtained by a clothes load estimation procedure, several of which are known in the art, or by user input. The specific manner in which this value is obtained does not constitute a part of the instant invention.

In this third preferred embodiment of the clothes blend detection method, a set of load-dependent membership functions is generated based on a computed average of water level signal amplitude. As used herein, the term "water level signal amplitude" is intended to refer to the average of the peak-to-peak variation in the water level signal generated by water level sensor 116, as the clothes load is initially agitated during the initial water fill stage.

The water level sensor 116 schematically illustrated in FIG. 1 and described in greater detail in the disclosure of the second preferred embodiment above, is suitable for use in this embodiment of the clothes blend detection method. The exact type of water level sensor is not critical to the practice of this blend detection method, nor is the particular mechanical configuration of the washer.

As with the first and second embodiments of the clothes blend detection method discussed above, an important aspect of this second embodiment is that the method relies on the fact that different fabrics absorb water at different rates and in different amounts relative to their mass. This results in a difference in the variation of the water level amplitude for each of various types of fabric. Pure cotton fabric, for example, absorbs more water per unit mass than does cotton/polyester blend fabric and pure polyester fabric. Cotton thus becomes heavier, and a clothes load of pure cotton will produce larger amplitude variations in the water level signal than will loads of cotton/polyester blends or loads of all polyester.

The relationship between the data acquired from the water level sensor and the fabric or clothes blend to be determined in this embodiment is best understood through an understanding of the processing of the raw data to final form. The raw water level amplitude data from the sensor is to be first processed to determine the peak-to-peak amplitude of variation in the signal. A representative plot of this raw data, showing the sensed water level, in inches, during the initial portion of the water filling cycle in a washing machine having a ten (10) pound cotton fabric load therein, is shown in FIG. 16.

Figure 16:
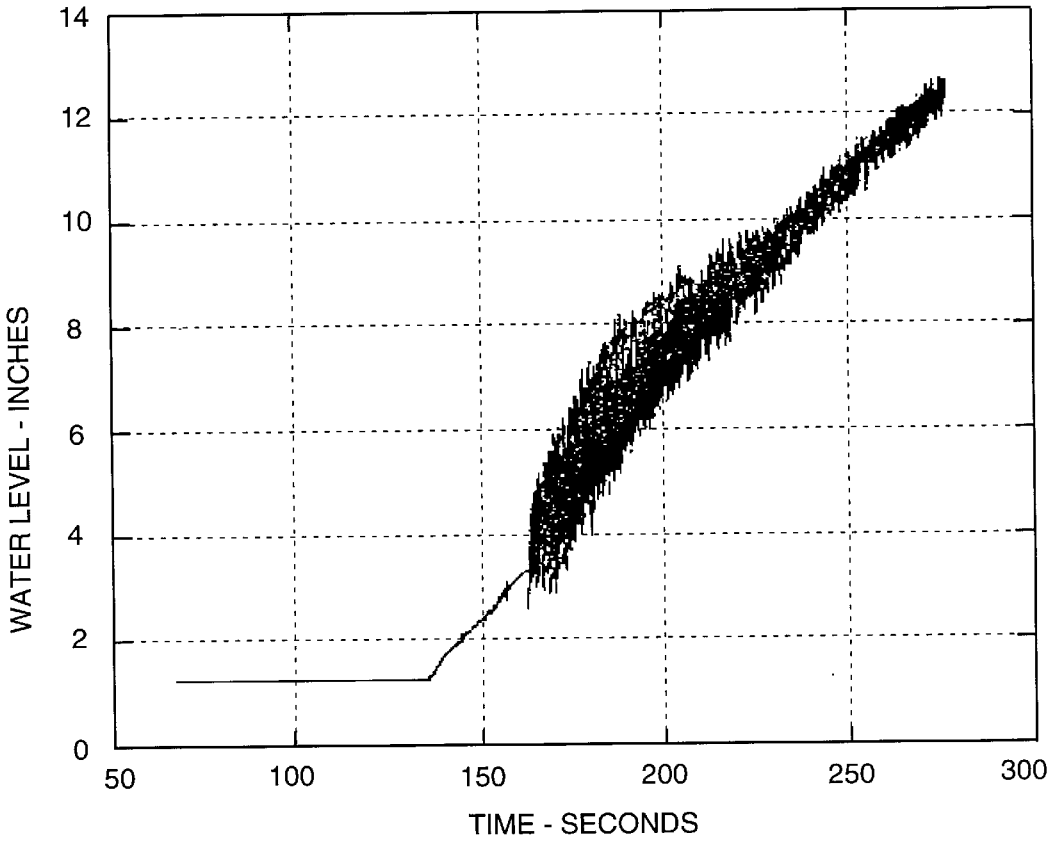
FIG. 16 is a representative graph plotting a sensed water level against time during an initial water fill and agitation cycle, which illustrates effect that agitation will have on the sensed water level.

During the first part (up to about 140 seconds) of the time period shown in FIG. 16, there is no change in the water level signal. This is due to the particular design of the water level pressure sensor described above, in which there is a dead zone in the water pressure tube 132, and no change in air pressure in the column is detected up to a certain fill level. As the fill progresses beyond that water volume, the pressure sensor starts to respond in a linear manner. At approximately 170 seconds into this exemplary fill process, the agitator is started at low speed. The water level sensor signal begins to oscillate, since the clothes and the water in the basket begin to be moved back and forth by the agitator. This oscillation tapers off as the water mass increases, and the effect of the particular clothes blend is reduced as the water level continues to increase.

Figure 17:
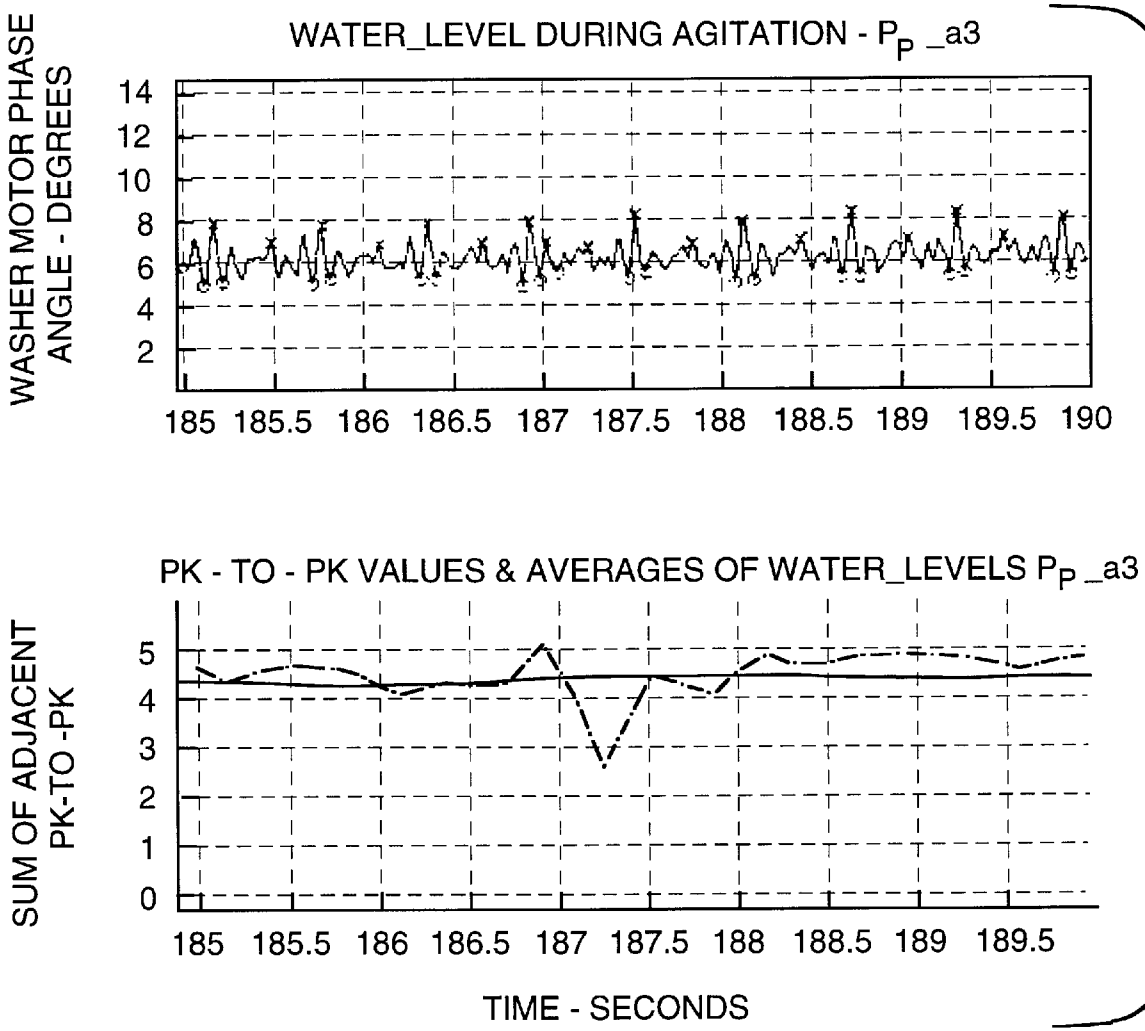
FIG. 17 is a representative graph showing the sensed peak-to-peak water level amplitude during a portion of the initial fill and agitation cycle, and showing the summing of adjacent peak-to-peak values and the averaging of those sums, in accordance with another embodiment of the present invention.

The first step in processing the raw water level data includes determining the peak-to-peak amplitude of variation in the signal. The upper graph in FIG. 17 plots the maximum and minimum detected water levels (marked by x's and o's, respectively) for a five-second period (185–190 seconds) of the water fill plotted in FIG. 16. The lower graph in FIG. 16 plots the amplitude of the water level oscillation, summed for two successive cycles of the agitator. This is done because there are two peaks in the water level signal for one complete back-and-forth motion cycle of the agitator.

The signal is further processed by averaging the water level amplitude data over a predetermined window, such as fifteen (15) peaks, with the result being illustrated overlaid on the amplitude plot on the lower graph in FIG. 17. These signal processing steps may preferably be conducted by a microprocessor forming a part of washer controller 114.

Figure 18:
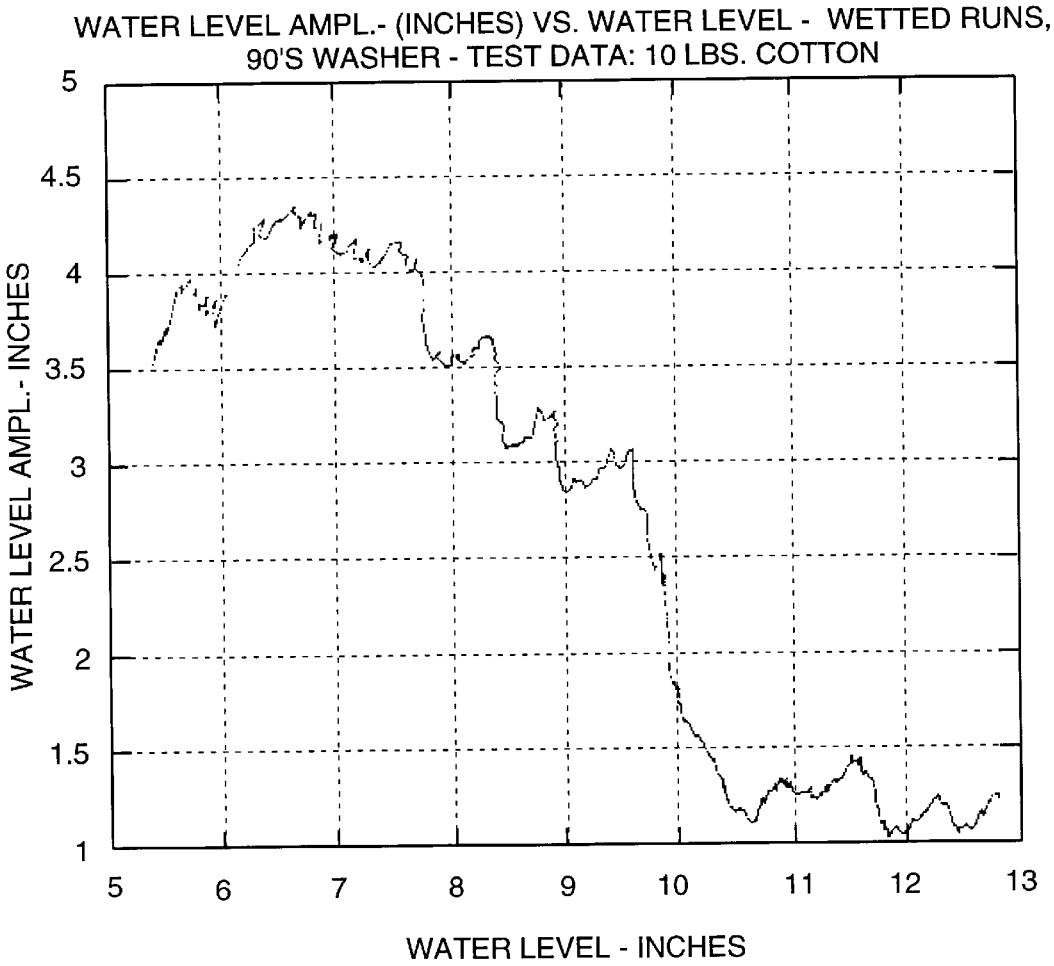
FIG. 18 is a graph plotting the sensed water level amplitude as a function of the water level in the washer tub for a given clothes load.
Figure 19:
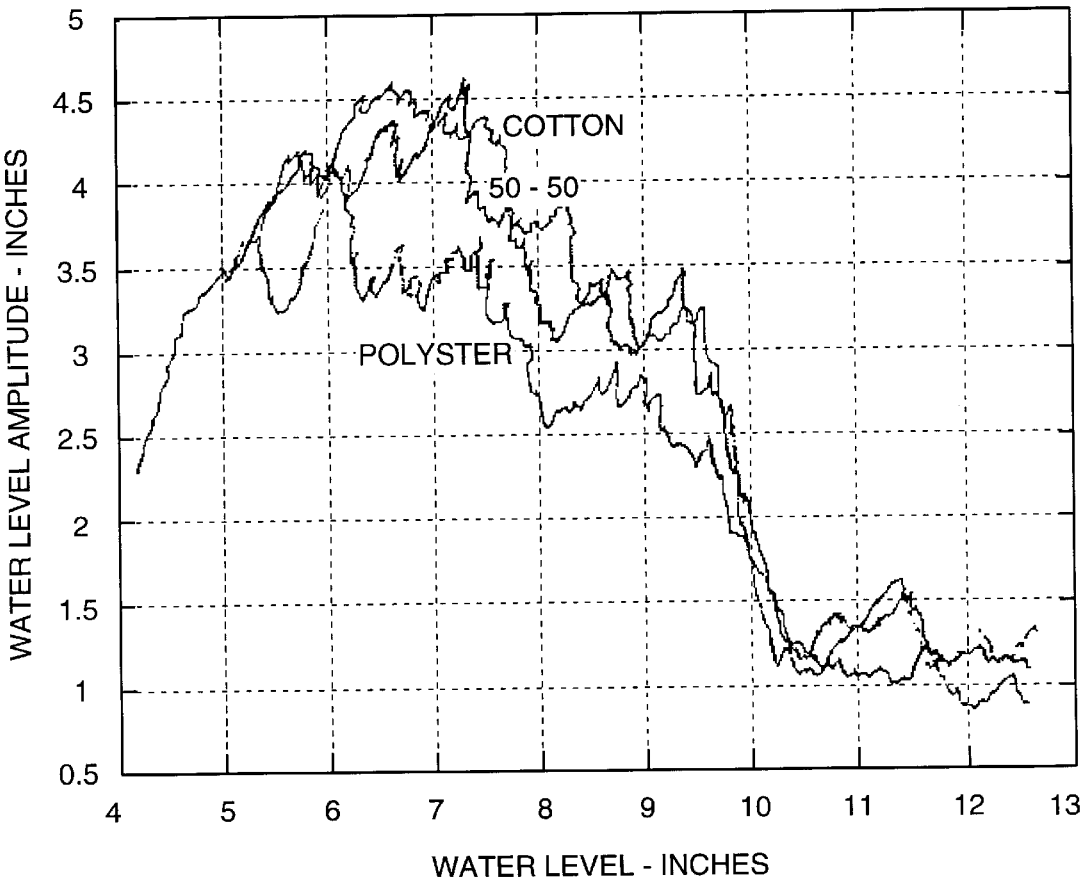
FIG. 19 is a graph plotting the sensed water level amplitude as a function of the water level for three different fabric blend types, in accordance with this alternative preferred embodiment.

FIG. 18 presents a plot of average water level amplitude as a function of the water level for the ten-pound all-cotton load from which the data of FIGS. 16 and 17 were obtained. FIG. 19 presents the same type of data for the ten-pound cotton load, as well as for a 10-pound load of a 50—50 blend of cotton and polyester, and for a 100% polyester load. It can be seen that, in general, the water level signal amplitude for all clothes blends ultimately diminishes with an increase in the overall water level as the clothes are being agitated. This is explained by the fact that the clothes become increasingly mobile in the washer as water is added, thereby causing a smaller variation in the water level signal. Also, as the overall mass of water is increased, the inertia of the water mass is increased, resulting in a smaller response to a fixed stimuli, in this case, the mechanical agitation.

At lower water levels, however, the water level amplitudes for various clothes blends are different. As can be seen in FIG. 19, for example, in the range of water levels surrounding a water level of about 6.5 inches, the water level amplitudes differ significantly for the three exemplary loads, and increase from the all-polyester load to the all-cotton load. This is again consistent with the fact that cotton fabric absorbs more water and becomes heavier than polyester for the same dry clothes mass. The blend detection method in this embodiment is based upon this different behavior of the water level amplitude with different clothes blends.

The blend detection method can be discussed in terms of a calibration portion or step, and a run-time portion or step. Preparatory to mass production and shipping of the clothes washing machines, a calibration table is generated for the particular washing machine configuration, using a derivation of data as discussed above with respect to FIGS. 15–19, and further working with that data.

It has been determined, in the development of this method, that an optimal water level, representing the water level at which there is a maximum separation between water level amplitudes associated with each fabric type, exists for each clothes load weight. In FIG. 19, for example, where the clothes load is ten (10) pounds, the optimal water level in the tub is about six and one-half inches, where the largest differences between water level amplitudes for the various fabric types are seen.

The calibration table for the particular washing machine configuration is generated by empirically determining, for a number of load sizes that can be handled by the washing machine, the optimal water level (as defined above) for each of the selected load sizes. In other words, data analogous to that presented in FIG. 19 is obtained for a number of load weights, for example, loads of two (2) pounds, six (6) pounds, ten (10) pounds, and fourteen (14) pounds. The data may be plotted for each load size to determine the optimal water level, or may otherwise be processed to determine the water level at which the maximum spread in water level amplitudes exists, for each load size.

As an example of the calibration step in this third preferred embodiment, several (36) runs were made with different loads of clothes for each of the same three fabric types as were used in the runs for which results are presented in FIG. 19. The runs were conducted with the two-pound, six-pound, ten-pound, and fourteen-pound loads, as a representative range of possible washer loads. An optimal water level for each load size was computed in processing the water level amplitude data, and FIG. 20 presents a plot of the average water level amplitude (also averaging the results from three runs for each clothes load/clothes blend combination) versus the load size, at the optimal water level for that load size, for each of the three different fabric types tested.

Figure 20:
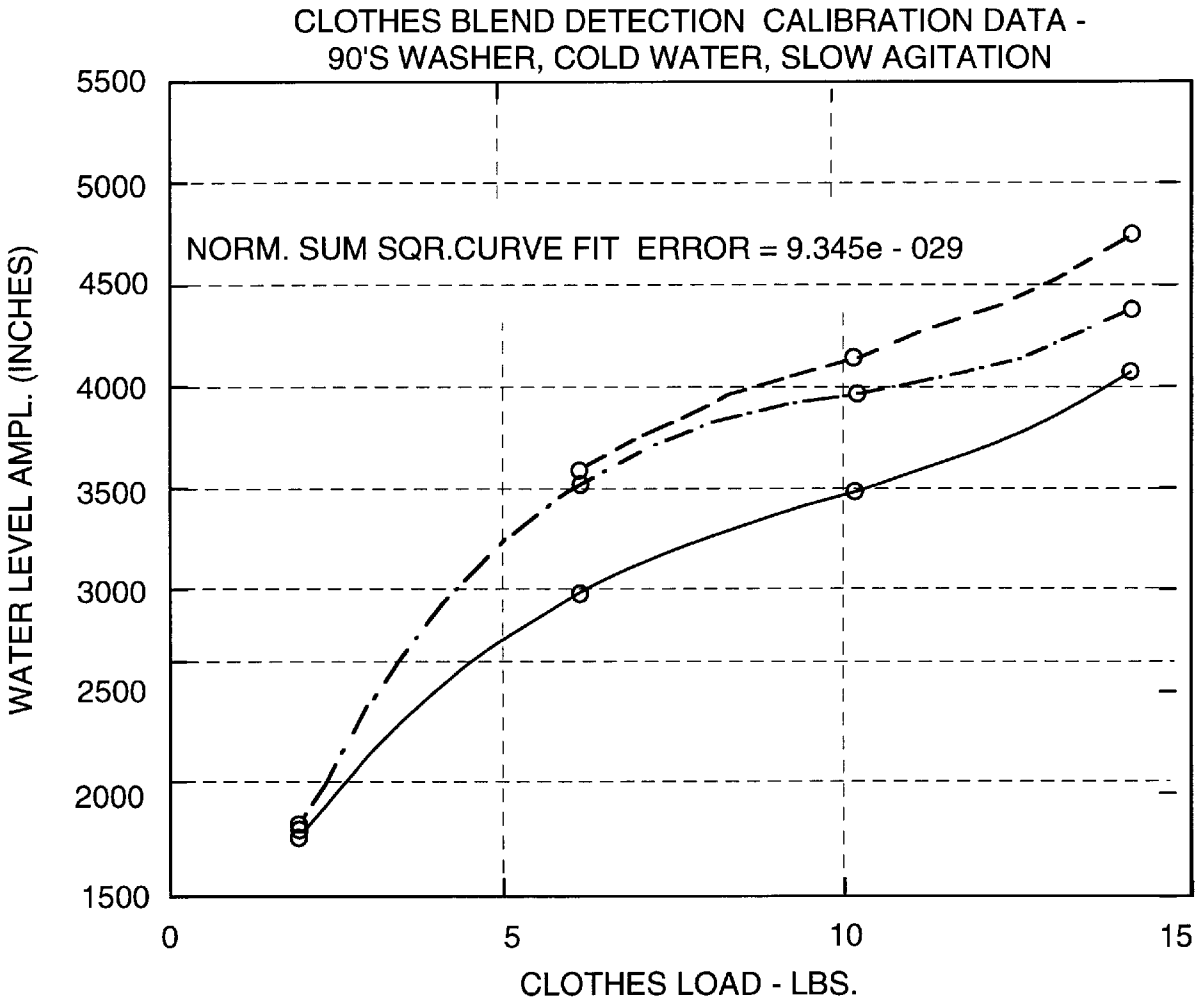
FIG. 20 is a graph plotting curves of the water level amplitude as a function of the weight of the clothes load, for the three types of clothes blends employed in developing the graph of FIG. 20.

While FIG. 20 and the ensuing discussion involve non-normalized data, for purposes of clarity it should be kept in mind that the water level amplitude data may preferably be normalized to the peak-to-peak amplitude of water level as obtained using an empty basket (i.e., no clothes load). Normalization of the data in this manner will minimize the error in the overall blend estimation method that can result from the slightly different performance of each individual washer unit produced, due to the use of manufacturing tolerances permitting minor variation in water level sensor accuracy and pressure tube length. Periodic normalization, once the washer is in use, can also aid in reducing any error in the blend detection method caused by the effects of mechanical aging of the components. Such normalization steps will be readily apparent to those of ordinary skill in the art upon reading this disclosure, and further details of such steps need not be provided herein.

A family of second order curves was fitted to the data points in FIG. 20 (four points for each fabric type). Individual items of clothing may have a different fabric make up or blend than the three fabric types selected for illustrative purposes herein, however, pure cotton and pure polyester fabrics can generally be assumed to require the greatest and the least motor torque, respectively, for a given clothes load weight. Indeed cottons and polyesters and blends thereof make up the vast majority of fabric types that would be washed in a washing machine.

The actual water level amplitudes that will be sensed in "run-time" will lie between the calibration curves plotted in FIG. 20 for cotton and polyester. A fuzzy logic approach for interpolating between the calibration lines has been determined to be a desirable way of accurately completing the clothes blend detection process.

A non-standard approach must be used for defining the membership functions to be applied to the fuzzy logic interpolation process, due to the overlap in water level amplitude values for the fabric types as the load increases, and due to the fact that the separation between the fabric type calibration lines is non-uniform (see FIG. 20) as a function of clothes load. The defined membership functions must therefore be made dependent on load size.

Referring back to FIG. 8, a representative or schematic mapping of the membership functions of the three fabric types for which the calibration table of FIG. 20 was prepared, is shown for a given load size. The only difference between the mapping of the membership functions in this third embodiment and in the first preferred embodiment is that, for the axis labeled T, the T represents the water level signal amplitude from a least squares fit in this embodiment whereas, in the first embodiment, T represented motor torque. The same assumptions regarding the adequacy of using the three fabric types applies, and the possibility of using a finer or a coarser partitioning, applies to this embodiment as well.

The membership functions illustrated in FIG. 8 are defined as trapezoids whose inflection points are determined by ordinates of the calibration lines in the calibration table of FIG. 20. The parameters of the membership functions, for any given load size, are the same as the parameters set forth in the disclosure of the first preferred embodiment, with the exception that the variables denominated by T ($T_P$, $T_B$, $T_C$, $T_{max}$) represent water level signal amplitude values instead of average motor torque values. Correspondingly, the values of $\sigma_P$, $\sigma_B$, $\sigma_C$ are defined as a spread (max—min), nominally the standard deviation or a fraction thereof, in water level signal amplitude values within a set of runs for a given load and fabric type.

In this embodiment, wherein water level signal amplitude values are to be sensed or calculated in determining the clothes blend, it is preferred that the $\sigma_P$, $\sigma_B$ and $\sigma_C$ values used in defining the parameters of the membership functions be equal to the standard deviation or spread in water level signal amplitude values, as it is believed that this will result in the most accurate clothes blend determinations in the run-time portion of the method. The fraction of the spread value used in the membership function definition can be varied to tune the performance or accuracy of the clothes blend determination method. The membership functions can further be automatically tuned using input-output data with known algorithms such as ANFIS (Adaptive Neuro-Fuzzy Inference System).

Figure 21:
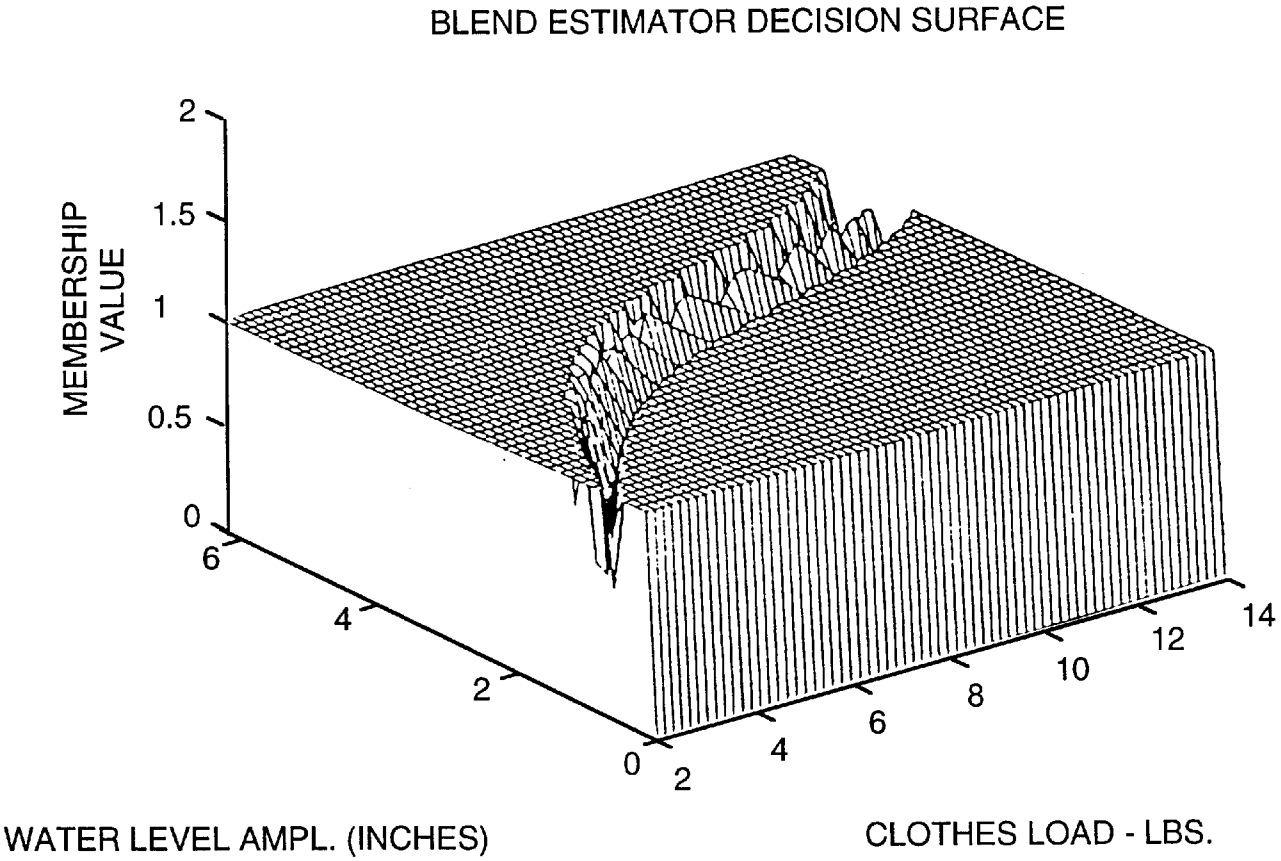
FIG. 21 is a three-dimensional representation of the set of membership functions for the three different fabric types across a range of clothes loads and as a function of water level amplitude in accordance with this alternative preferred embodiment.

FIG. 21 illustrates a three-dimensional plot of all of the membership functions generated for the entire range of anticipated load sizes, from two (2) pounds to fourteen (14) pounds, a typical capacity of a clothes washing machine for home use. The three-dimensional plot can be referred to as a decision surface, and the decision surface may be generated and stored as a look-up table in a read-only memory (ROM) of the washer controller 114. Alternatively, a set of load dependent membership functions can be calculated at run-time, provided the calibration line fit data and the definitions of the membership function parameters are stored for use by the controller 114.

In the run-time step or portion of this third preferred embodiment of the clothes blend detection method, a user places items of clothing or other fabric to be washed into the washer, and the collective group of items will thus be an arbitrary or unknown mix of fabric types. An estimation of the clothes load weight is either selected by the user, or is determined in the very initial stage of the wash cycle, by a known means. The wash cycle is started, with the water being introduced into the washer tub 106. The output signal of the water level detector is monitored by controller 114, and the average peak-to-peak water level amplitude is computed continuously during the process of water filling in the washer tub, while the agitator is running. At the predefined optimal water level for the clothes load value previously obtained, the average peak-to-peak water level is stored. The controller stores the data point in memory, and then calculates the membership functions using the calibration data and the parameter constraints as discussed above, or by accessing a previously stored look-up table containing the data representing the decision surface of FIG. 21.

Figure 22:
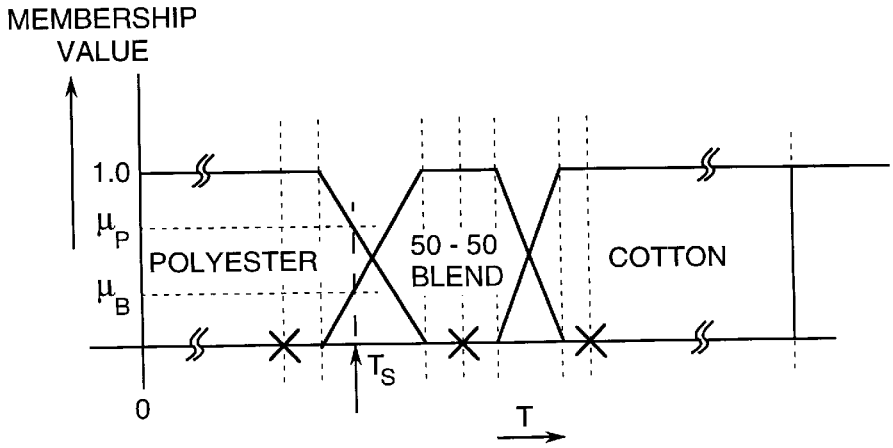
FIG. 22 is an illustration of a plot of membership functions at a given clothes load, showing the degree of fulfillment in each membership function by a particular measured water level amplitude.

Once the membership functions have been ascertained, the clothes blend is then calculated by computing the degree of fulfillment of the stored average water level signal amplitude in each of the membership functions for cotton, 50—50 cotton/polyester blend, and polyester. This computation or inferencing process yields a triplet of numbers, $\mu_C$, $\mu_B$, $\mu_P$, corresponding to the proportions of cotton, 50—50 blend, and polyester, respectively, in the clothes load being washed. A graphical representation of the inferencing process can be seen in FIG. 22, wherein $T_S$ is the point along the axis labeled T representing the sensed and stored water level signal amplitude, as applied to the set of membership functions calculated or retrieved for the specific clothes load. As can be seen in the example in that Figure, the membership value or degree of fulfillment for polyester fabric, $\mu_P$ is approximately 0.67, and the membership value for the 50—50 blend fabric is approximately 0.33. The membership value for cotton fabric is 0 in this example, indicating that the detection method inferenced that there was no pure cotton fabric in the clothes load, based on the low value of the sensed water level signal amplitude.

The washer controller 114 may preferably use the information obtained from this clothes blend detection method to set or control various washer operating states or parameters that will be best suited to cleaning the particular clothes blend detected, as described previously with respect to the first preferred embodiment.

In a demonstration of the accuracy of the blend detection method in this embodiment, it was determined that the mean squared error (MSE), as defined previously, using the method for a grouping of sixty-seven (67) test cases, was computed to be 0.793. As the maximum possible MSE is 2.0, the above detection method has an error rate of 39.65%, as a percentage of the largest possible error. This demonstration establishes that the method is sufficiently accurate for determining a clothes blend for the purposes of controlling washer operating states or parameters in washing clothes.

In the clothes blend detection method of the foregoing three embodiments, it can be seen that an accurate estimation or determination of the clothes blend of successive clothes loads may be obtained, without greatly increasing the cost of the sensors to be installed in the washer. Though the method has been described with respect to detecting the clothes blend of clothes loads for use in controlling a clothes washer, it is understood that the method may be employed in other appliance control systems. Further, while the invention has been described herein with respect to the specific embodiments and features, it will be appreciated that the utility of the invention is not thus limited. Other variations, modifications, and alternative embodiments are encompassed by the invention, and, accordingly, the invention is to be broadly construed as comprehending all such alternative variations, modifications and other embodiments within its spirit and scope.

What is claimed is:

1. A method for detecting a mix of fabric types making up a load of items disposed in a clothes washer, comprising:

obtaining a value of a dry weight of said load of items disposed in said clothes washer;

developing for said dry weight value, a set of fuzzy logic membership functions corresponding to a plurality of fabric types that may be included in said load of items, each of said membership functions being dependent upon at least one washer operating state to be sensed;

sensing a value of said at least one washer operating state; and computing a degree of fulfillment of the sensed value of said washer operating state in each of the set of membership functions, wherein said degree of fulfillment in each of said membership function represents the relative proportion of a fabric type represented by each of said membership functions.

2. A method as recited in claim 1, further comprising the step of determining, in advance of developing said set of fuzzy logic membership functions, a maximum and a minimum possible value of said at least one washer operating state at said dry weight load value, and wherein said maximum and minimum values are employed in said developing of said set of fuzzy logic membership functions.

3. A method as recited in claim 2 further comprising determining, in advance of developing said set of fuzzy logic membership functions, a standard deviation in values of said at least one washer operating state at said dry weight load value, and wherein a predetermined fraction of said standard deviation is employed in said development of said set of fuzzy logic membership functions.

4. A method as recited in claim 3, wherein said set of fuzzy logic membership functions includes a first membership function developed to correspond to an all-cotton fabric load, a second membership function developed to correspond to an all-synthetic fabric load, and a third membership function developed to correspond to a fabric load consisting of a predetermined blend of cotton and synthetic fabrics.

5. A method as recited in claim 4, wherein said predetermined blend of cotton and synthetic fibers is a blend of fifty percent cotton fabric and fifty percent synthetic fabric.

6. A method as recited in claim 1, wherein said set of fuzzy logic membership functions includes a first membership function developed to correspond to an all-cotton fabric load, a second membership function developed to correspond to an all-synthetic fabric load, and a third membership function developed to correspond to a fabric load consisting of a predetermined blend of cotton and synthetic fabrics.

7. A method as recited in claim 6, wherein said predetermined blend of cotton and synthetic fibers is a blend of fifty percent cotton fabric and fifty percent synthetic fabric.

8. A method as recited in claim 1, wherein said step of sensing at least one operating state value includes sensing, during an initial agitation and water fill stage, a phase angle of an induction motor employed to drive a washer agitator, continuously computing an average value of a peak-to-peak variation in said motor phase angle, and storing said average peak-to-peak value in a memory of a washer controller at a predefined water level as water is added to said clothes washer.

9. A method as recited in claim 8, wherein said predefined water level is a water level at which average peak-to-peak motor phase angle values for different fabric types differ by the greatest amount for said dry weight load value, and wherein said method employs said stored average peak-to-peak motor phase angle value as said sensed washer operating state value in said step of computing said degree of fulfillment in each of said set of membership functions.

10. A method as recited in claim 1, wherein said step of sensing at least one operating state value comprises sensing a signal corresponding to a water level in said clothes washer as said washer is filled, and detecting a water level inflection point at which a change in water level is first reflected in said sensed signal, wherein a value of said water level inflection point comprises said washer operating state value used in computing said degree of fulfillment in each of said set of membership functions.

11. A method as recited in claim 1, wherein said step of sensing at least one operating state value comprises sensing an amplitude of oscillation of a water level signal from a water level sensor as said clothes washer is being filled with water and as said clothes load is agitated, averaging the sensed oscillation amplitudes, storing an average sensed oscillation value upon reaching a predetermined water level, and employing said stored value as said sensed value in determining the degree of fulfillment of said sensed value in said set of membership functions.

12. A method as recited in claim 1, further comprising:

developing a plurality of sets of fuzzy logic membership functions for a predetermined range of load weights capable of being handled by said clothes washer, wherein a set of membership functions for each load weight within said range of load weights represent different fabric types that may be present in a load of items, and wherein said membership functions are defined, using fuzzy logic, at least in part as a function of a value of said at least one washer operating state to be sensed, relative to a predetermined maximum and minimum value, at said load weight, of said at least one operating state;

storing said plurality of sets of membership functions in a memory of a clothes washer controller;

sensing, during an initial operation portion of a washing cycle, a value of said predetermined washer operating state;

computing said degree of fulfillment of said sensed value in each membership function by looking up, in said washer controller memory, the set of membership functions corresponding to said obtained value of said load weight, and by determining a membership value in each membership function defined at said load weight at said sensed value of said washer operating state.

13. A method as recited in claim 12, wherein each of said plurality of sets of fuzzy logic membership functions includes a first membership function developed to correspond to an all-cotton fabric load, a second membership function developed to correspond to an all-synthetic fabric load, and a third membership function developed to correspond to a fabric load consisting of a predetermined blend of cotton and synthetic fabrics.

14. A method as recited in claim 12, wherein said step of sensing at least one operating state value includes sensing, during an initial agitation and water fill stage, a phase angle of an induction motor employed to drive a washer agitator, continuously computing an average value of a peak-to-peak variation in said motor phase angle, and storing said average peak-to-peak value in a memory of a washer controller at a predefined water level as water is added to said clothes washer, wherein said predefined water level is a water level at which average peak-to-peak motor phase angle values for different fabric types differ by the greatest amount for said dry weight lead value, and wherein said method employs said stored average peak-to-peak motor phase angle value as said sensed washer operating state value in said step of computing said degree of fulfillment in each of said set of membership functions.

15. A method as recited in claim 12, wherein said step of sensing at least one operating state value comprises sensing a signal corresponding to a water level in said clothes washer as said washer is filled, and detecting a water level inflection point at which a change in water level is first reflected in said sensed signal, wherein a value of said water level inflection point comprises said washer operating state value used in computing said degree of fulfillment in each of said set of membership functions.

16. A method as recited in claim 12, wherein said step of sensing at least one operating state value comprises sensing an amplitude of oscillation of a water level signal from a water level sensor as said clothes washer is being filled with water and as said clothes load is agitated, averaging the sensed oscillation amplitudes, storing an average sensed oscillation value upon reaching a predetermined water level, and employing said stored value as said sensed value in determining the degree of fulfillment of said sensed value in said set of membership functions.

17. A method for detecting a mix of fabric types making up a load of items disposed in a clothes washer comprising:

in a calibration portion, establishing a range of possible values of a predetermined washer operating parameter as a function of a range of fabric types, for a range of load weights capable of being processed by said clothes washer;

defining, using fuzzy logic, a plurality of sets of membership functions for said range of load weights, each membership function at each load weight corresponding to a predetermined fabric type and further being defined at least in part as a function of said predetermined washer operating parameter to be sensed; and in a run-time portion, obtaining a value of the load weight for the items loaded in said clothes washer;

sensing a value of said predetermined washer operating parameter;

retrieving data corresponding to said set of membership functions defined at said load weight; and computing a degree of fulfillment of the sensed washer operating parameter in each of said membership functions corresponding to said predetermined fabric type, said degree of fulfillment in each of said membership functions indicating a relative proportion of the fabric type represented by said membership function.

18. A method as recited in claim 17, wherein each of said plurality of sets of membership functions includes a first membership function developed to correspond to an all-cotton fabric load, a second membership function developed to correspond to an all-synthetic fabric load, and a third membership function developed to correspond to a fabric load consisting of a predetermined blend of cotton and synthetic fabrics.

19. A method as recited in claim 18, wherein said predetermined blend of cotton and synthetic fibers is a blend of fifty percent cotton fabric and fifty percent synthetic fabric.

20. A washer controller comprising a microprocessor having a set of data stored therein necessary to define a set of fuzzy logic membership functions, for a given fabric load, representative of a plurality of fabric types that may be introduced into a washer, said controller further including means for receiving an input signal generated by a washer operating state sensor and for receiving an input signal corresponding to a weight of a fabric load present in a washer;

said controller further having means for detecting a relative proportion of various predetermined fabric types in a fabric load present in a washer, by processing said operating state input signal, said fabric load weight signal and said data defining said set of fuzzy logic membership functions to determine a level of fulfillment in each membership function, at said fabric load weight, of said sensed washer operating state; and said controller further having means for sending a control signal based upon a detected blend of fabric types to at least one washer component to control at least one washer operating parameter.

* * * * *